US010124981B2

(12) United States Patent
Sawada et al.

(10) Patent No.: US 10,124,981 B2
(45) Date of Patent: Nov. 13, 2018

(54) SHEET PROCESSING APPARATUS AND IMAGE FORMING SYSTEM INCLUDING MULTIPLE FOLDING MEMBERS

(71) Applicants: Ken Sawada, Kanagawa (JP); Shigeru Mizuno, Kanagawa (JP); Hiroyuki Kuno, Kanagawa (JP); Takuya Fukuhara, Kanagawa (JP)

(72) Inventors: Ken Sawada, Kanagawa (JP); Shigeru Mizuno, Kanagawa (JP); Hiroyuki Kuno, Kanagawa (JP); Takuya Fukuhara, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/613,583

(22) Filed: Jun. 5, 2017

(65) Prior Publication Data

US 2017/0267483 A1 Sep. 21, 2017

Related U.S. Application Data

(63) Continuation of application No. 14/706,153, filed on May 7, 2015, now Pat. No. 9,688,502.

(30) Foreign Application Priority Data

May 20, 2014 (JP) ..... 2014-104446
Jan. 22, 2015 (JP) ..... 2015-010430

(51) Int. Cl.
*B65H 45/14* (2006.01)

(52) U.S. Cl.
CPC ..... *B65H 45/14* (2013.01); *B65H 2220/08* (2013.01); *B65H 2511/224* (2013.01); *B65H 2801/27* (2013.01)

(58) Field of Classification Search
CPC .... B65H 45/14; B65H 45/18; B65H 2220/08; B65H 2801/27
See application file for complete search history.

(56) References Cited

U.S. PATENT DOCUMENTS

| | | | | |
|---|---|---|---|---|
| 3,328,026 | A | 6/1967 | Bartizal | |
| 3,773,315 | A | 11/1973 | Tsien | |
| 4,099,710 | A | 7/1978 | Boyer et al. | |
| 6,475,129 | B1 * | 11/2002 | Lehmann | B65H 45/144 493/25 |
| 7,736,290 | B2 | 6/2010 | Oshiro et al. | |
| 9,688,502 | B2 * | 6/2017 | Sawada | B65H 45/14 |
| 2005/0239624 | A1 | 10/2005 | Dannemann et al. | |

(Continued)

FOREIGN PATENT DOCUMENTS

| | | | |
|---|---|---|---|
| JP | H10-129878 | A | 5/1998 |
| JP | 2000-128420 | A | 5/2000 |

(Continued)

*Primary Examiner* — Patrick H Mackey
(74) *Attorney, Agent, or Firm* — Harness, Dickey & Pierce, P.L.C.

(57) ABSTRACT

A sheet processing apparatus that forms a folding line on a sheet includes first and second folding rollers that form a folding line on the sheet by rotating a bent sheet while pinching from sheet surfaces and a first pressing unit that presses the second folding roller against the first folding roller in an arbitrary portion in a rotating shaft direction of the second folding roller.

21 Claims, 23 Drawing Sheets

(56) References Cited

U.S. PATENT DOCUMENTS

| | | | |
|---|---|---|---|
| 2012/0178607 | A1 | 7/2012 | Yasuda |
| 2014/0141956 | A1 | 5/2014 | Suzuki et al. |
| 2014/0147184 | A1 | 5/2014 | Kunieda et al. |
| 2014/0171283 | A1 | 6/2014 | Furuhashi et al. |
| 2014/0179504 | A1 | 6/2014 | Nakada et al. |
| 2014/0336031 | A1 | 11/2014 | Suzuki et al. |
| 2014/0364295 | A1 | 12/2014 | Watanabe et al. |
| 2015/0031520 | A1 | 1/2015 | Nakada et al. |
| 2015/0336765 | A1 | 11/2015 | Sawada et al. |

FOREIGN PATENT DOCUMENTS

| | | | | |
|---|---|---|---|---|
| JP | 2001-063106 | A | | 3/2001 |
| JP | 2011-136798 | A | | 7/2011 |
| JP | 2011136798 | A | * | 7/2011 |
| JP | 2012-144312 | A | | 8/2012 |

* cited by examiner

SINGLE FOLDING

QUADRUPLE FOLDING

SHEET PROCESSING APPARATUS AND IMAGE FORMING SYSTEM INCLUDING MULTIPLE FOLDING MEMBERS

CROSS-REFERENCE TO RELATED APPLICATIONS

This application is a continuation application of and claims priority under 35 U.S.C. § 120/121 to U.S. application Ser. No. 14/706,153 filed May 7, 2015, which claims priority under 35 U.S.C. § 119 to Japanese Patent Application No. 2014-104446 filed in Japan on May 20, 2014 and Japanese Patent Application No. 2015-010430 filed in Japan on Jan. 22, 2015, the entire contents of each of which are hereby incorporated by reference herein.

BACKGROUND OF THE INVENTION

1. Field of the Invention

The present invention relates to a sheet processing apparatus and an image forming system, and more particularly, to a sheet folding process.

2. Description of the Related Art

In recent years, information has been converted in a digital form, and an image processing apparatus such as a printer or a facsimile used to output digital information or a scanner used to convert a document in a digital form has become an indispensable device. Such an image processing apparatus has, for example, an image capturing function, an image forming function, and a communication function and is usually configured as a multifunction peripheral that can be used as a printer, a facsimile, a scanner, and a copy machine.

Among such multifunction peripherals, a multifunction peripheral equipped with a folding processing apparatus that performs a folding process of folding a sheet on which an image is formed after rendering an image by forming an image on a fed sheet has been known. Typically, the folding processing apparatus includes a folding processing roller pair configured with two folding processing rollers laterally bridging in a direction parallel to a folding line to be formed, and forms a folding line at a folding position by pinching a bend formed at the folding position from both sheet surfaces through the folding processing roller pair while rotating the folding processing roller pair (for example, JP 2012-144312 A).

At this time, the folding processing apparatus generates pressing force over the whole area in a direction perpendicular to a sheet conveyance direction by applying force for pressing the folding processing rollers against each other in both ends of the folding processing roller pair in the direction perpendicular to the sheet conveyance direction. Thus, in the folding processing apparatus, when the sheet is pinched by the folding processing roller pair, repulsive force is generated from the sheet against the pressing force, but the force of pressing the folding processing roller against each other acts as a force countering the repulsive force near both ends in the direction perpendicular to the sheet conveyance direction, and thus the sheet can be sufficiently pressed by the force although the repulsive force acts.

Meanwhile, in the folding processing apparatus according to the related art, since no force countering the repulsive force acts near a central portion in the direction perpendicular to the sheet conveyance direction, when the repulsive force acts, the folding processing rollers are bent in a direction opposite to a pressing direction, and thus there is a problem in that it is difficult to sufficiently press the sheet.

Further, in the folding processing apparatus according to the related art, since the force for pressing the folding processing rollers against each other acts on both ends of the folding processing roller pair in the direction perpendicular to the sheet conveyance direction, a deviation of pressing force occurs between both ends. As a result, in the folding processing apparatus according to the related art, it is difficult to press the sheet evenly at one end and the other end, and a wrinkle or a skew occurs in the sheet, or the folding position is misaligned, resulting in a reduction in a folding quality.

Therefore, there is a need for a sheet processing apparatus and an image forming system capable of forming a folding line on a sheet effectively and improve a folding quality.

SUMMARY OF THE INVENTION

It is an object of the present invention to at least partially solve the problems in the conventional technology.

There is provided a sheet processing apparatus that forms a folding line on the sheet, includes first and second folding rollers that form a folding line on a sheet by rotating a bent sheet while pinching from sheet surfaces, and a first pressing unit that presses the second folding roller against the first folding roller in an arbitrary portion in a rotating shaft direction of the second folding roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an exemplary embodiment of the present invention will be described in detail with reference to the appended drawings. In the present embodiment, an image forming apparatus that forms an image on a sheet such as a fed sheet and then performs a folding process of forming a folding line in the image-formed sheet in a direction perpendicular to a sheet conveyance direction will be described as an example.

An image forming apparatus according to the present embodiment includes a folding processing roller pair configured with two folding processing rollers laterally bridging in a direction parallel to a folding line to be formed, and forms a folding line at a folding position by pinching a bend formed at the folding position from both sheet surfaces through the folding processing roller pair while rotating the folding processing roller pair.

In the image forming apparatus having the above configuration, one of gist of the present embodiment lies in that force of pressing the two folding processing rollers configuring the folding processing roller pair against each other is caused to act near a central portion in a direction perpendicular to a sheet conveyance direction serving as a rotating shaft direction thereof. Thus, the image forming apparatus according to the present embodiment can generate sufficient pressing force evenly over the whole area in the direction perpendicular to the sheet conveyance direction. According to the image forming apparatus according to the present embodiment, it is possible to form a folding line on a sheet effectively and improve a folding quality.

Figure 1:
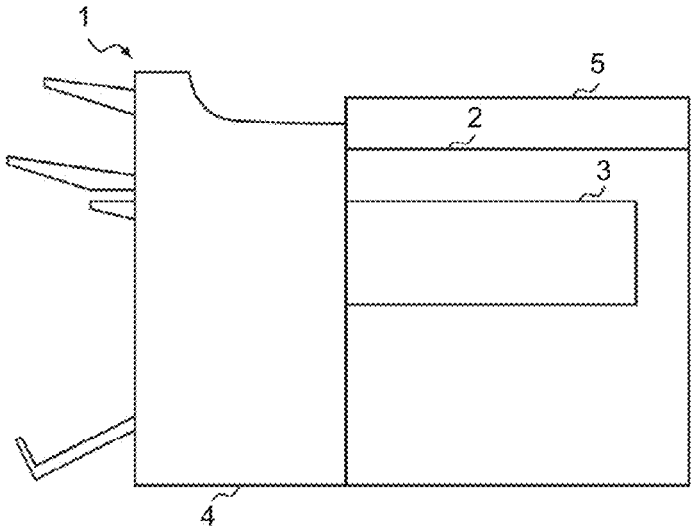
FIG. 1 is a diagram schematically illustrating an overall configuration of an image forming apparatus according to an embodiment of the present invention.

First, an overall configuration of an image forming apparatus 1 according to the present embodiment will be described with reference to FIG. 1. FIG. 1 is a diagram schematically illustrating an overall configuration of the image forming apparatus 1 according to the present embodiment. The image forming apparatus 1 according to the present embodiment includes an image forming unit 2, a folding processing unit 3, a post-processing unit 4, and a scanner unit 5 as illustrated in FIG. 1.

The image forming unit 2 generates rendering information of CMYK (Cyan Magenta Yellow Key Plate) based on input image data, and performs an image forming output on a fed sheet based on the generated rendering information. The folding processing unit 3 performs a folding process on an image-formed sheet conveyed from the image forming unit 2. In other words, in the present embodiment, the folding processing unit 3 functions as a sheet processing apparatus. Thereafter, the post processing unit 4 performs post-processing such as binding, stapling, or punching on the folded sheet conveyed from the folding processing unit 3.

The scanner unit 5 converts an original in a digital form by scanning an original through a linear image sensor in which a plurality of photodiodes are arranged in a line, and light receiving elements such as a Charge Coupled Device (CCD) image sensor or a Complementary Metal Oxide Semiconductor (CMOS) image sensor are arranged in parallel to the photodiodes. Here, the image forming apparatus 1 according to the present embodiment is a MultiFunction Peripheral (MFP) that has, for example, an image capturing function, an image forming function, and a communication function and can be used as a printer, a facsimile, a scanner, or a copy machine.

Figure 2:
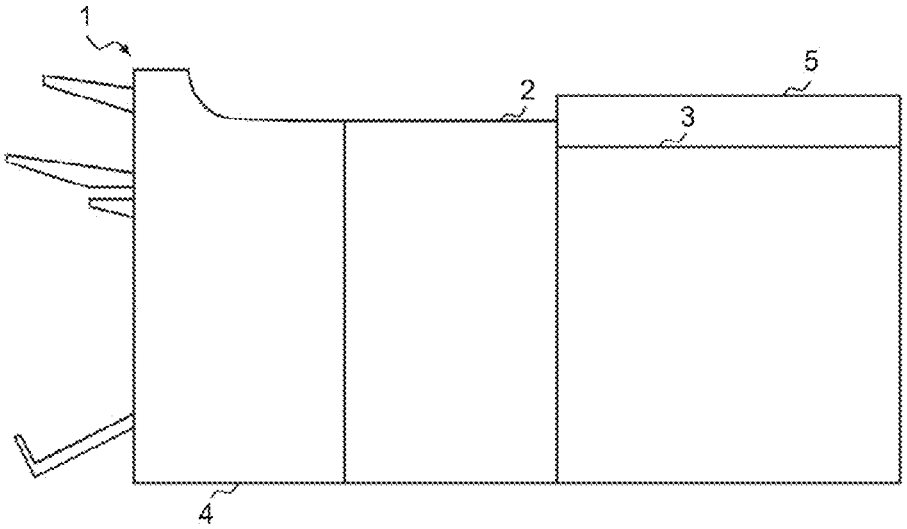
FIG. 2 is a diagram schematically illustrating an overall configuration of an image forming apparatus according to an embodiment of the present invention.

FIG. 1 illustrates the configuration of the image forming apparatus 1 in which the folding processing unit 3 is arranged in the body of the image forming unit 2, but the image forming apparatus 1 may have a configuration in which the folding processing unit 3 is independently arranged as illustrated in FIG. 2. FIG. 2 is a diagram schematically illustrating an overall configuration of the image forming apparatus 1 according to the present embodiment.

Figure 3:
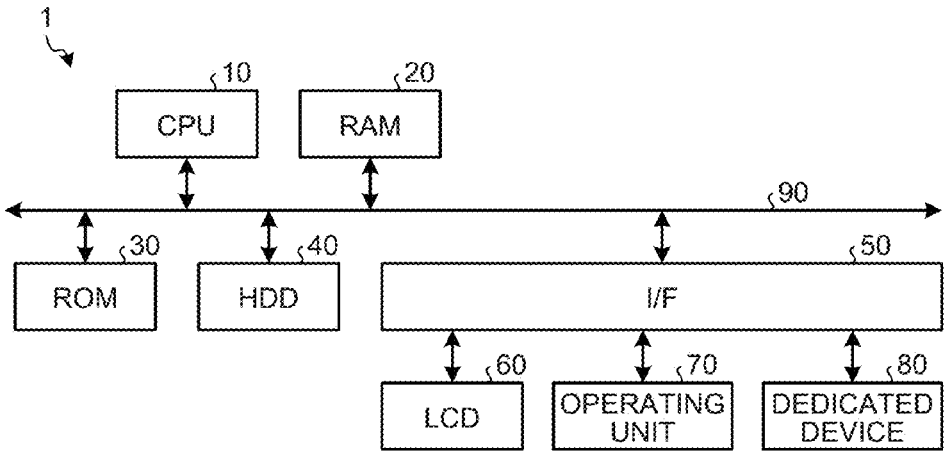
FIG. 3 is a block diagram schematically illustrating a hardware configuration of an image forming apparatus according to an embodiment of the present invention.

Next, a hardware configuration of the image forming apparatus 1 according to the present embodiment will be described with reference to FIG. 3. FIG. 3 is a block diagram schematically illustrating a hardware configuration of the image forming apparatus 1 according to the present embodiment. Here, the image forming apparatus 1 includes an engine for implementing a scanner, a printer, the folding process, post-processing, and the like in addition to the hardware configuration illustrated in FIG. 3.

The image forming apparatus 1 according to the present embodiment has the same configuration as a common server, a common personal computer (PC), or the like as illustrated in FIG. 3. In other words, in the image forming apparatus 1 according to the present embodiment, a Central Processing Unit (CPU) 10, a Random Access Memory (RAM) 20, a Read Only Memory (ROM) 30, a Hard Disk Drive (HDD) 40, and an I/F 50 are connected with one another via a bus 90. Further, a Liquid Crystal Display (LCD) 60, an operating unit 70, and a dedicated device 80 are connected to the I/F 50.

The CPU 10 is an operation unit, and controls an operation of the image forming apparatus 1 in general. The RAM 20 is a volatile storage medium in which reading and writing of information can be performed at a high speed, and used as a work area when the CPU 10 processes information. The ROM 30 is a read only non-volatile storage medium, and stores a program such as firmware. The HDD 40 is a non-volatile storage medium in which reading and writing information can be performed, and stores an Operating System (OS), various kinds of control programs, various kinds of application programs, or the like.

The I/F 50 connects the bus 90 with various kinds of hardware or networks, and performs control. The LCD 60 is a visual user interface by which the user checks a state of the image forming apparatus 1. The operating unit 70 is a user interface such as a keyboard or a mouse by which the user inputs information to the image forming apparatus 1.

The dedicated device 80 is hardware for implementing a dedicated function in the image forming unit 2, the folding processing unit 3, the post-processing unit 4, and the scanner unit 5, and is a plotter device that performs an image forming output on a plane of paper in the image forming unit 2. Further, the dedicated device 80 is a conveying mechanism that conveys a sheet or a folding processing mechanism that folds a conveyed sheet in the folding processing unit 3. A configuration of the folding processing mechanism included in the folding processing unit 3 is one of the gists of the present embodiment.

Further, the dedicated device 80 is a post-processing mechanism that performs post processing on the sheet that has been subjected to the folding process by the folding processing unit 3 and then is conveyed in the post-processing unit 4. Furthermore, the dedicated device 80 is a scanning device that scans an image being displayed on a plane of paper in the scanner unit 5.

In this hardware configuration, a software control unit is configured such that a program stored in a storage medium such as the ROM 30, the HDD 40, or an optical disk (not illustrated) is read out to the RAM 20, and the CPU 10 performs an operation according to the program loaded onto the RAM 20. Functional blocks of implementing a function of the image forming apparatus 1 according to the present embodiment is configured with a combination of the software control unit and the hardware configured as described above.

Figure 4:
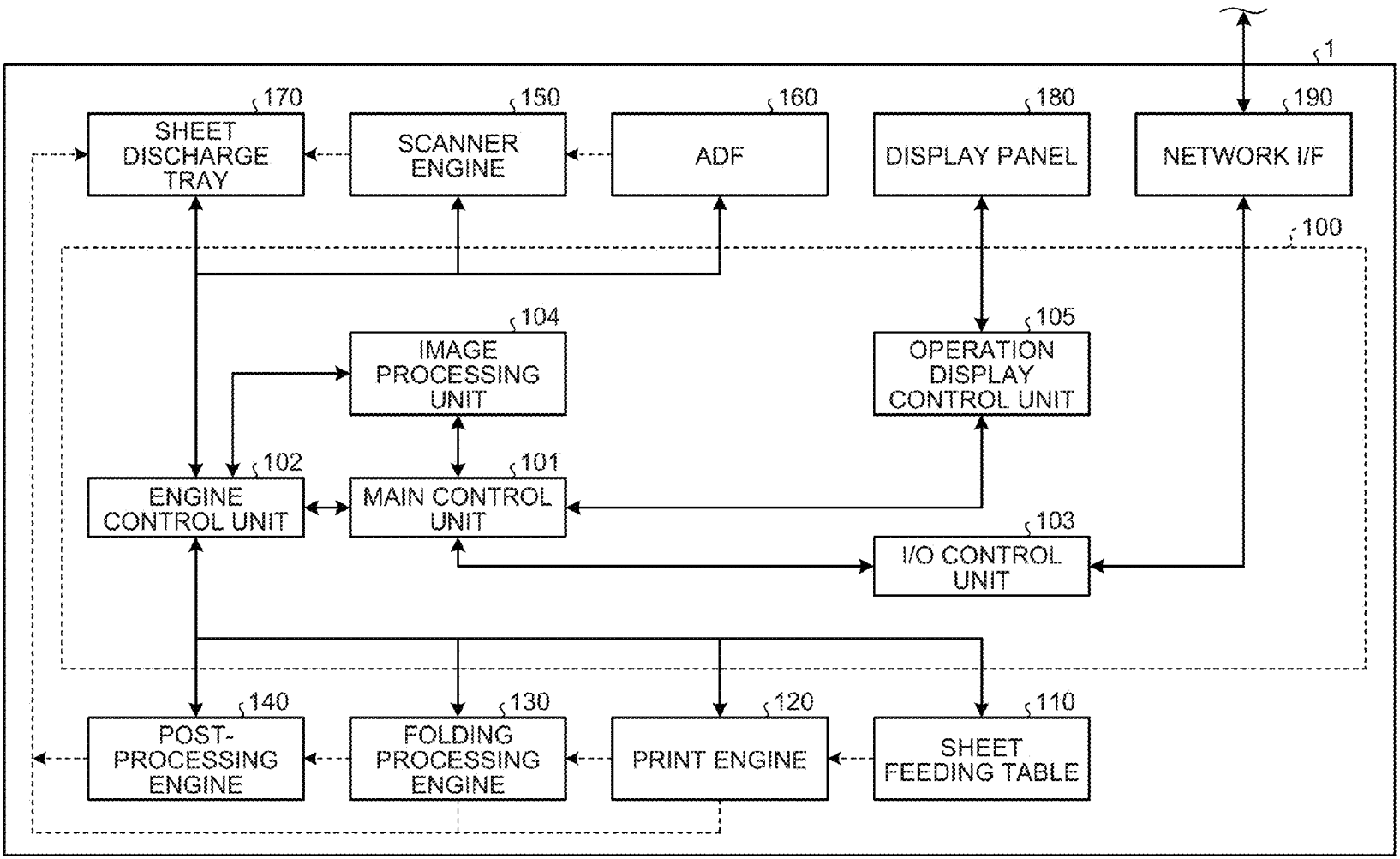
FIG. 4 is a block diagram schematically illustrating a functional configuration of an image forming apparatus according to an embodiment of the present invention.

Next, a functional configuration of the image forming apparatus 1 according to the present embodiment will be described with reference to FIG. 4. FIG. 4 is a block diagram schematically illustrating a functional configuration of the image forming apparatus 1 according to the present embodiment. In FIG. 4, an electrical connection is indicated by a solid line arrow, and the flow of a bundle of sheets or documents is indicated by a dotted line arrow.

The image forming apparatus 1 according to the present embodiment includes a controller 100, a sheet feeding table 110, a print engine 120, a folding processing engine 130, a post-processing engine 140, a scanner engine 150, an Auto Document Feeder (ADF) 160, a sheet discharge tray 170, a display panel 180, and a network I/F 190 as illustrated in FIG. 4. Further, the controller 100 includes a main control unit 101, an engine control unit 102, an I/O control unit 103, an image processing unit 104, and an operation display control unit 105.

The sheet feeding table 110 feeds the sheet to the print engine 120 serving as an image forming unit. The print engine 120 is an image forming unit with which the image forming unit 2 is equipped, and renders an image by performing an image forming output on the sheet conveyed from the sheet feeding table 110. As a specific example of the print engine 120, an image forming mechanism employing an inkjet scheme, an image forming mechanism employing an electrophotography scheme, or the like may be used. The image-formed sheet which has been subjected to the image rendered by the print engine 120 is conveyed to the folding processing unit 3 or discharged to the sheet discharge tray 170.

The folding processing engine 130 is arranged in the folding processing unit 3, and performs the folding process on the image-formed sheet conveyed from the image forming unit 2. The folded sheet that has been subjected to the folding process by the folding processing engine 130 is conveyed to the post-processing unit 4. The post-processing engine 140 is arranged in the post-processing unit 4, and performs post processing such as stapling, punching, and binding on the folded sheet conveyed from the folding processing engine 130. The sheet that has been subjected to the post processing by the post-processing engine 140 is discharged to the sheet discharge tray 170.

The ADF 160 is arranged in the scanner unit 5, and automatically conveys an original to the scanner engine 150 serving as an original scanning unit. The scanner engine 150 is arranged in the scanner unit 5, and is an original scanning unit including a photoelectric conversion element that converts optical information into an electrical signal, and generates image information by optically scanning an original automatically conveyed by the ADF 160 or an original set on a platen glass (not illustrated). The original that is automatically conveyed by the ADF 160 and scanned by the scanner engine 150 is discharged to the sheet discharge tray installed in the ADF 160.

The display panel 180 is not only an output interface that visually displays the state of the image forming apparatus 1 but also an input interface serving as a touch panel that enables the user to directly operate the image forming apparatus 1 or input information to the image forming apparatus 1. In other words, the display panel 180 has a function of displaying an image used to receive an operation performed by the user. The display panel 180 is implemented by the LCD 60 and the operating unit 70 of FIG. 3.

The network I/F 190 is an interface that enables the image forming apparatus 1 to communicate with other devices such as an administrator terminal via a network, and an interface such as Ethernet (a registered trademark), a Universal Serial Bus (USB) interface, Bluetooth (a registered trademark), Wireless Fidelity (Wi-Fi), FeliCa (a registered trademark), or the like is used. The network I/F 190 is implemented by the I/F 50 illustrated in FIG. 3.

The controller 100 is configured with a combination of software and hardware. Specifically, the controller 100 is configured with hardware such as an integrated circuit (IC) and a software control unit that is configured such that a control program such as firmware stored in a non-volatile storage medium such as the ROM 30 or the HDD 40 is loaded onto the RAM 20, and the CPU 10 performs an operation according to the program. The controller 100 functions as a control unit that controls the image forming apparatus 1 in general.

The main control unit 101 plays a role to control the respective units included in the controller 100, and gives a command to the respective units of the controller 100. Further, the main control unit 101 controls the I/O control unit 103, and accesses other devices through the network I/F 190 and the network. The engine control unit 102 controls or drives a driving unit such as the print engine 120, the folding processing engine 130, the post-processing engine 140, or the scanner engine 150. The I/O control unit 103 inputs a signal or a command input through the network I/F 190 and the network to the main control unit 101.

The image processing unit 104 generates rendering information based on document data or image data included in an input print job according to control of the main control unit 101. The rendering information is data such as bitmap data of CMYK and refers to information used when the print engine 120 serving as the image forming unit renders an image to be formed in the image forming operation. Further, the image processing unit 104 processes imaging data input from the scanner engine 150, and generates image data. The image data refers to information that is stored in the image forming apparatus 1 as a result of the scanner operation or transmitted to another device through the network I/F 190 and the network. The operation display control unit 105 causes the display panel 180 to perform an information display or notifies the main control unit 101 of information input through the display panel 180.

Figure 5:
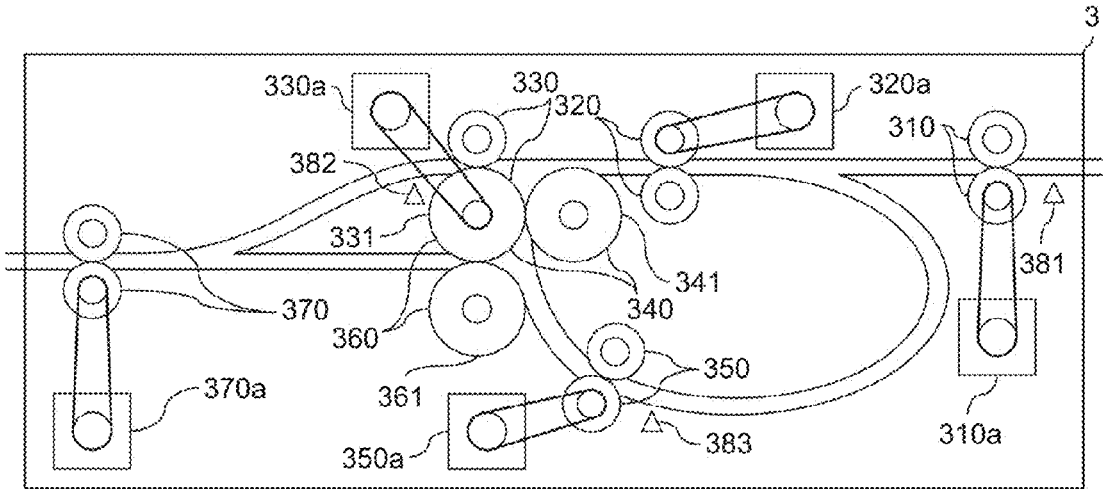
FIG. 5 is a cross-sectional view illustrating a folding processing unit according to an embodiment of the present invention when viewed in a direction perpendicular to a sheet conveyance direction.

Next, an internal structure of the folding processing unit 3 according to the present embodiment will be described with reference to FIG. 5. FIG. 5 is a cross-sectional view illustrating the folding processing unit 3 according to the present embodiment when viewed in the direction perpendicular to the sheet conveyance direction.

The folding processing unit 3 according to the present embodiment includes an entrance conveying roller pair 310, a registration roller pair 320, a first forward-reverse rotating roller pair 330, a first folding processing roller pair 340, a second forward-reverse rotating roller pair 350, a second folding processing roller pair 360, a discharging roller pair 370, a first sensor 381, a second sensor 382, and a third sensor 383 as illustrated in FIG. 5.

The entrance conveying roller pair 310 is rotationally driven by an entrance conveying roller pair drive motor **310*a*, receives an image-formed sheet conveyed from the image forming unit 2, and conveys the sheet toward the registration roller pair 320**.

The registration roller pair 320 is rotationally driven by a registration roller pair drive motor **320*a*, performs registration correction on the sheet by stopping rotation by a certain period of time in a state in which a leading edge of the sheet conveyed from the entrance conveying roller pair 310 abuts on a nip portion, and conveys the sheet toward the first forward-reverse rotating roller pair 330 or the first folding processing roller pair 340**.

The first forward-reverse rotating roller pair 330 is rotationally driven by a first forward-reverse rotating roller pair drive motor **330*a*, and a rotation direction of the first forward-reverse rotating roller pair 330** is reversed as necessary.

One roller of the first folding processing roller pair 340 also serves as one first forward-reverse rotating roller 331 of the first forward-reverse rotating roller pair 330, and the first folding processing roller pair 340 is rotationally driven by the first forward-reverse rotating roller pair drive motor **330*a* through the first forward-reverse rotating roller 331. Thus, the rotation direction of the first folding processing roller pair 340 is reversed at the first forward-reverse rotating roller pair 330. Hereinafter, one roller of the first folding processing roller pair 340 that does not serve as the first forward-reverse rotating roller 331 is referred to as a "first folding processing roller 341**."

The second forward-reverse rotating roller pair 350 is rotationally driven by a second forward-reverse rotating roller pair drive motor 350*a*, and a rotation direction of the second forward-reverse rotating roller pair 350 is reversed as necessary.

One roller of the second folding processing roller pair 360 also serves as one first forward-reverse rotating roller 331 of the first forward-reverse rotating roller pair 330, and the second folding processing roller pair 360 is rotationally driven by the first forward-reverse rotating roller pair drive motor 330*a* through the first forward-reverse rotating roller 331. Thus, the rotation direction of the second folding processing roller pair 360 is reversed at the first forward-reverse rotating roller pair 330. Hereinafter, one roller of the second folding processing roller pair 360 that does not serve as the first forward-reverse rotating roller 331 is referred to as a "second folding processing roller 361." In other words, in the present embodiment, each of the first forward-reverse rotating roller 331, the first folding processing roller 341, and the second folding processing roller 361 functions as any one of a first folding roller, a second folding roller, and a third folding roller.

The discharging roller pair 370 is rotationally driven by a discharging roller pair drive motor 370*a*, conveys the sheet to the post-processing unit 4 or discharges the sheet to the sheet discharge tray 170.

The first sensor 381 detects the leading edge of the sheet conveyed from the image forming unit 2 in the conveyance direction. When the leading edge of the sheet in the conveyance direction is detected by the first sensor 381, the folding processing unit 3 according to the present embodiment causes the entrance conveying roller pair 310 to start rotating.

The second sensor 382 detects the leading edge of the sheet conveyed from the first forward-reverse rotating roller pair 330 in the conveyance direction. The folding processing unit 3 according to the present embodiment reverses the rotation direction of the first forward-reverse rotating roller pair 330 at a point in time at which the sheet is conveyed by a certain distance S1 after the leading edge of the sheet is detected by the second sensor 382.

The third sensor 383 detects the leading edge of the sheet conveyed from the second forward-reverse rotating roller pair 350 in the conveyance direction. The folding processing unit 3 according to the present embodiment reverses the rotation direction of the second forward-reverse rotating roller pair 350 at a point in time at which the sheet is conveyed by a certain distance S2 after the leading edge of the sheet is detected by the third sensor 383.

Here, the folding processing unit 3 according to the present embodiment decides the distances S1 and S2 based on a size and a folding method of the sheet. Thus, it is necessary to store the different distances S1 and S2 according to the size and the folding method of the sheet in the folding processing unit 3 according to the present embodiment. Further, the folding processing unit 3 according to the present embodiment determines whether or not the sheet has been actually conveyed by the distance S1 based on a rotation amount of the first forward-reverse rotating roller pair 330, and determines whether or not the sheet has been actually conveyed by the distance S2 based on a rotation amount of the second forward-reverse rotating roller pair 350.

Next, an exemplary operation when the folding processing unit 3 according to the present embodiment performs the folding process will be described with reference to FIGS. 6A to 8C. FIGS. 6A to 8C are cross-sectional views illustrating the folding processing unit 3 performing the folding processing operation in the image forming apparatus 1 according to the present embodiment when viewed in the direction perpendicular to the sheet conveyance direction. Here, an operation of each operating unit described below is performed by control of the main control unit 101 and the engine control unit 102. FIGS. 6A to 8C illustrate an exemplary operation when the folding processing unit 3 according to the present embodiment performs Z folding on the sheet.

Figure 6A:
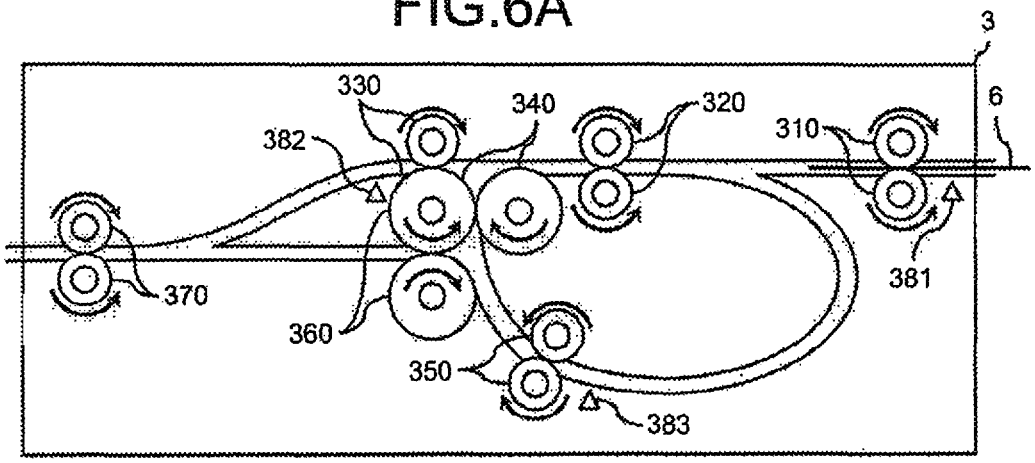
FIGS. 6A to 6C are cross-sectional views illustrating a folding processing unit performing a folding processing operation in an image forming apparatus according to an embodiment of the present invention when viewed in a direction perpendicular to a sheet conveyance direction.

In order to perform the folding processing operation through the folding processing unit 3 of the image forming apparatus 1 according to the present embodiment, when a sheet 6 is conveyed from the image forming unit 2, and the leading edge of the sheet 6 in the conveyance direction is detected by the first sensor 381 as illustrated in FIG. 6A, the entrance conveying roller pair 310 starts to rotate, the image-formed sheet 6 conveyed from the image forming unit 2 is received by the entrance conveying roller pair 310, and the sheet 6 is conveyed toward the registration roller pair 320.

Figure 6B:
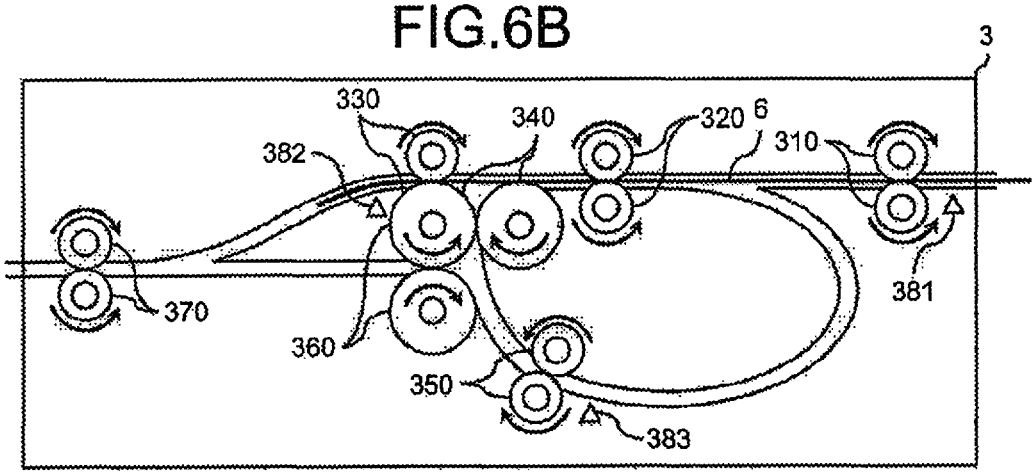

Then, the folding processing unit 3 performs the registration correction on the image-formed sheet 6 conveyed by the entrance conveying roller pair 310 through the registration roller pair 320, and then conveys the sheet 6 toward an upstream side in the conveyance direction through the first forward-reverse rotating roller pair 330 as illustrated in FIG. 6B.

Figure 6C:
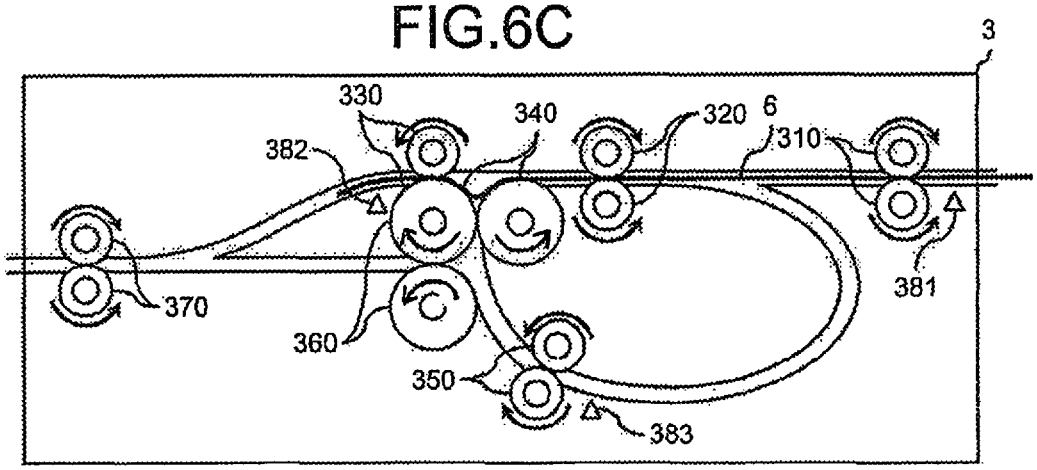

Thereafter, when the sheet 6 is conveyed by the certain distance S1 after the leading edge of the sheet 6 in the conveyance direction is detected by the second sensor 382, the folding processing unit 3 causes a first folding position of the sheet 6 to be bent to the first folding processing roller pair 340 side so that a position of a formed bend does not deviate by reversing the rotation direction of the first forward-reverse rotating roller pair 330, and guides the bend to the nip portion of the first folding processing roller pair 340 by further conveying the sheet 6 as illustrated in FIG. 6C.

Figure 7A:
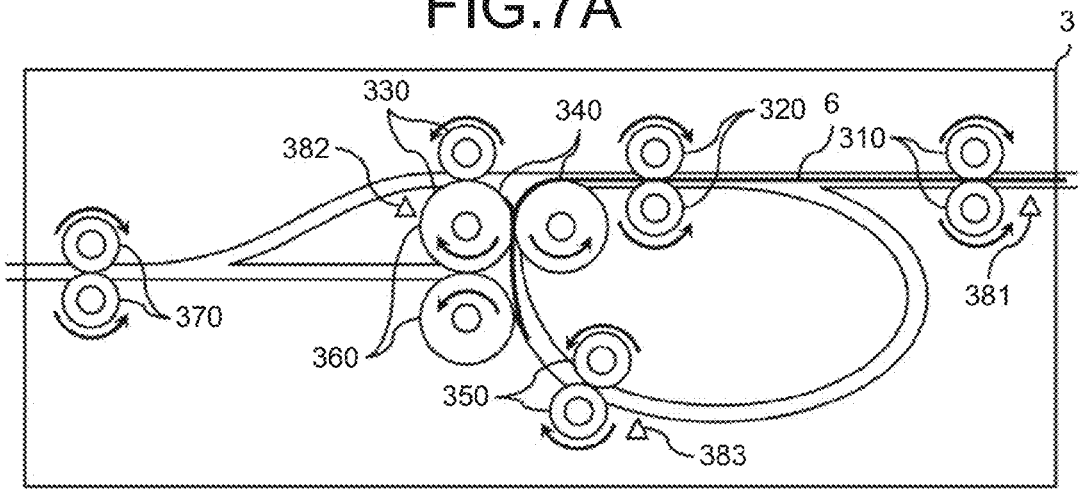
FIGS. 7A to 7C are cross-sectional views illustrating a folding processing unit performing a folding processing operation in an image forming apparatus according to an embodiment of the present invention when viewed in a direction perpendicular to a sheet conveyance direction.
Figure 7B:
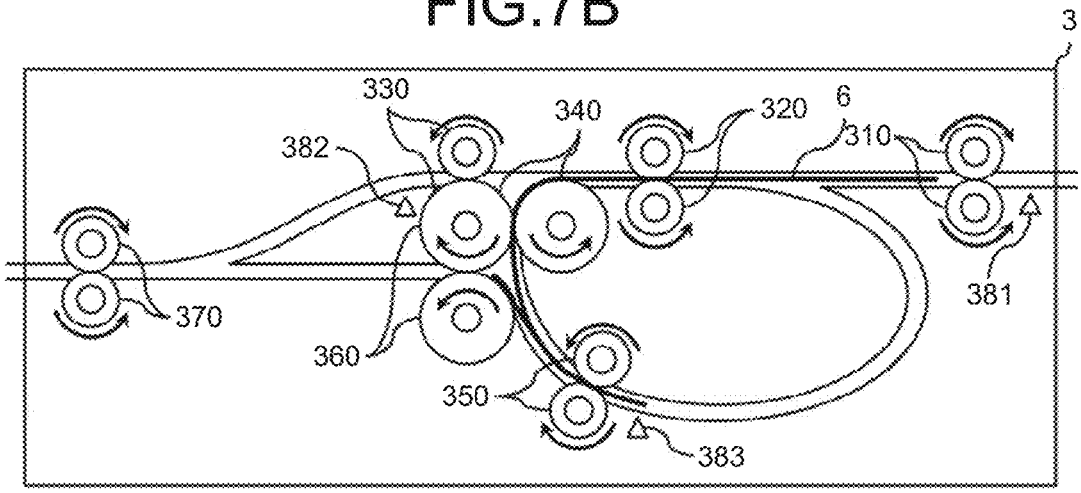
Figure 7C:
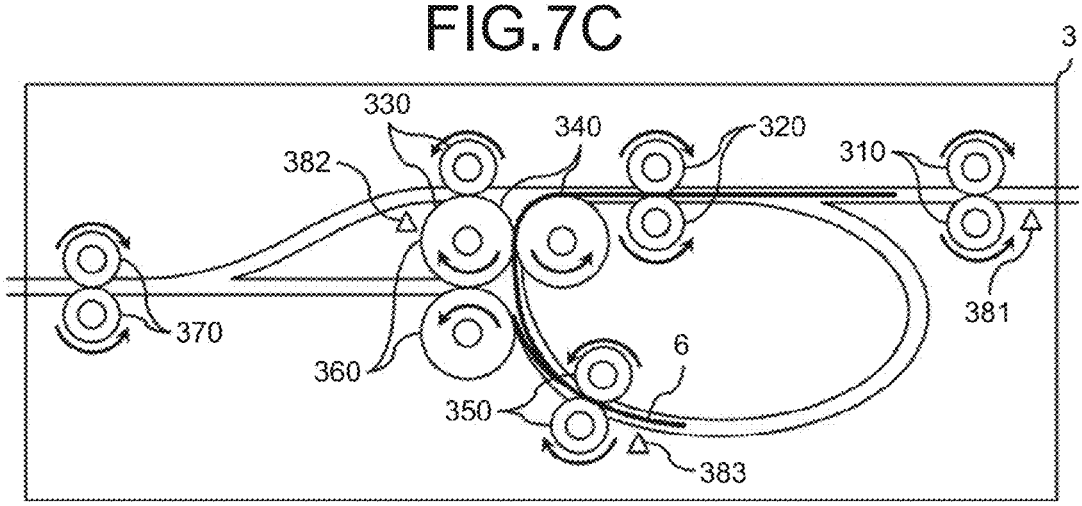

Then, the folding processing unit 3 forms a folding line at the first folding position by pinching the bend formed on the sheet 6 from both surfaces at the nip portion of the first folding processing roller pair 340 as illustrated in FIG. 7A, and conveys the sheet 6 toward the second forward-reverse rotating roller pair 350 and further conveys the sheet 6 to the upstream side in the conveyance direction as illustrated in FIGS. 7B and 7C.

Figure 8A:
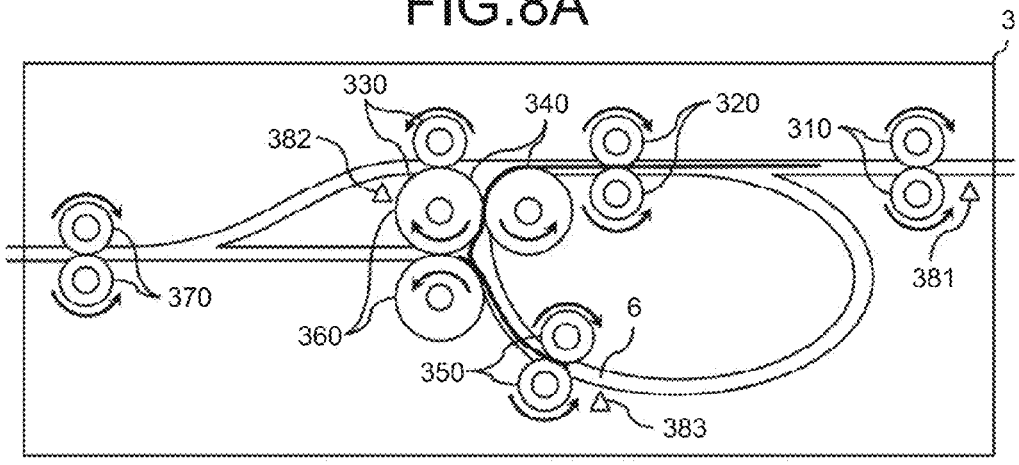
FIGS. 8A to 8C are cross-sectional views illustrating a folding processing unit performing a folding processing operation in an image forming apparatus according to an embodiment of the present invention when viewed in a direction perpendicular to a sheet conveyance direction.

Thereafter, when the sheet 6 is conveyed by the certain distance S2 after the leading edge of the sheet 6 in the conveyance direction is detected by the third sensor 383, the folding processing unit 3 causes a second folding position of the sheet 6 to be bent to the second folding processing roller pair 360 side so that the position of the formed bend does not deviate by reversing the rotation direction of the second forward-reverse rotating roller pair 350, and guides the bend to the nip portion of the second folding processing roller pair 360 by further conveying the sheet 6 as illustrated in FIG. 8A.

Figure 8B:
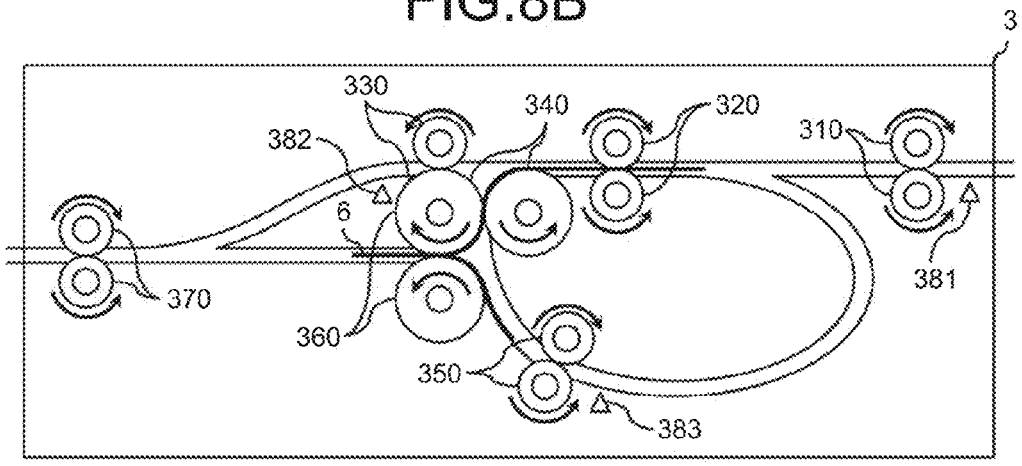

Then, the folding processing unit 3 forms a folding line at the second folding position by pinching the bend formed on the sheet 6 from both surfaces at the nip portion of the second folding processing roller pair 360, and conveys the sheet 6 toward the discharging roller pair 370 as illustrated in FIG. 8B.

Figure 8C:
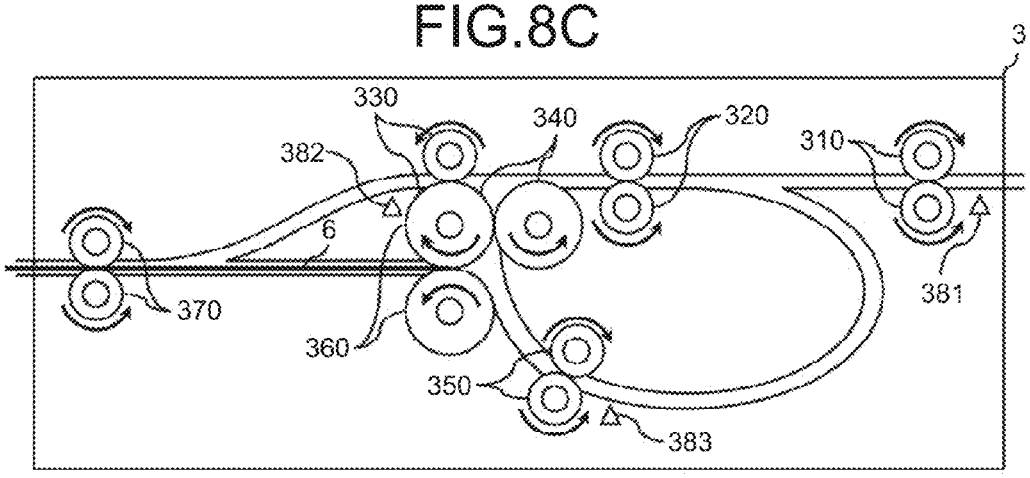

Thereafter, the folding processing unit 3 conveys the sheet 6 to the post-processing unit 4 through the discharging roller pair 370 or discharges the sheet 6 to the sheet discharge tray 170 as illustrated in FIG. 8C.

Figure 9:
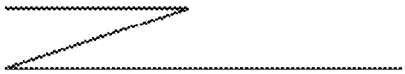
FIG. 9 is a diagram illustrating an exemplary shape of a folded sheet that has been subjected to a folding process by a folding processing unit according to an embodiment of the present invention.
Figure 10A:
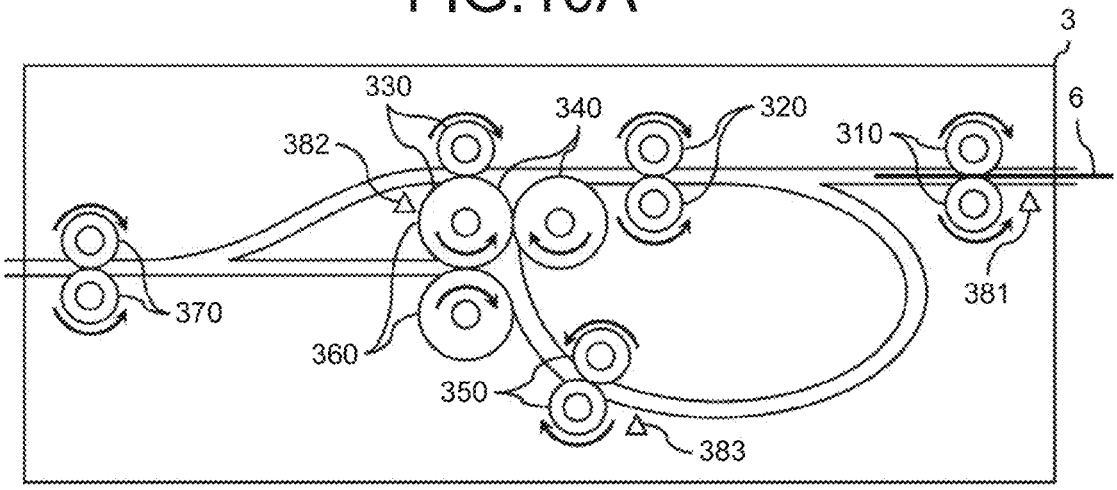
FIGS. 10A to 10C are cross-sectional views illustrating a folding processing unit performing a folding processing operation in an image forming apparatus according to an embodiment of the present invention when viewed in a direction perpendicular to a sheet conveyance direction.
Figure 10B:
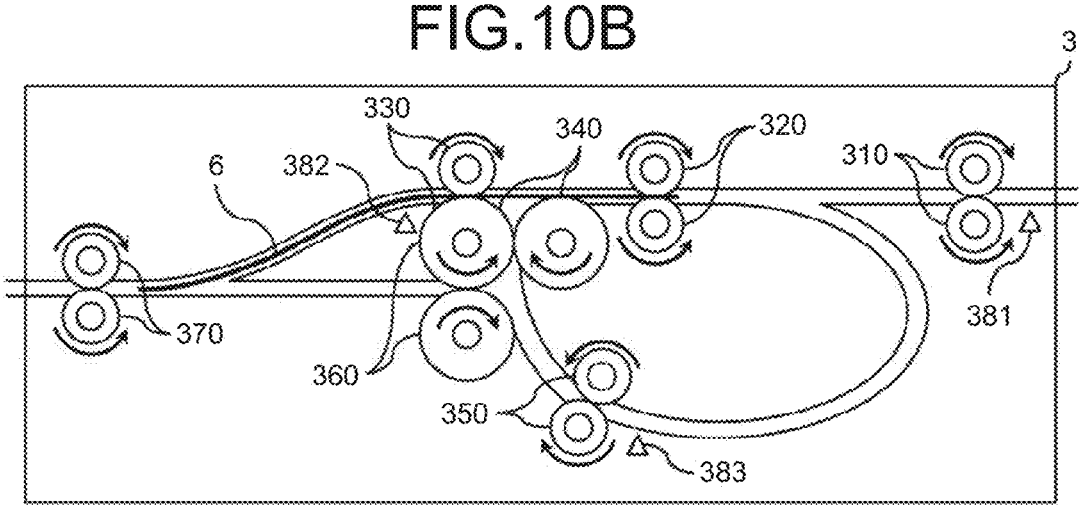
Figure 10C:
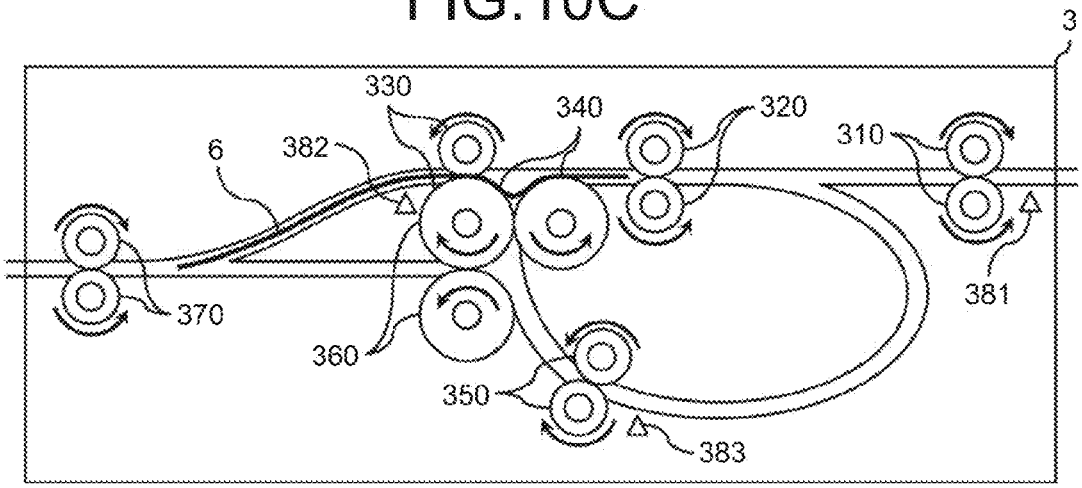
Figure 11A:
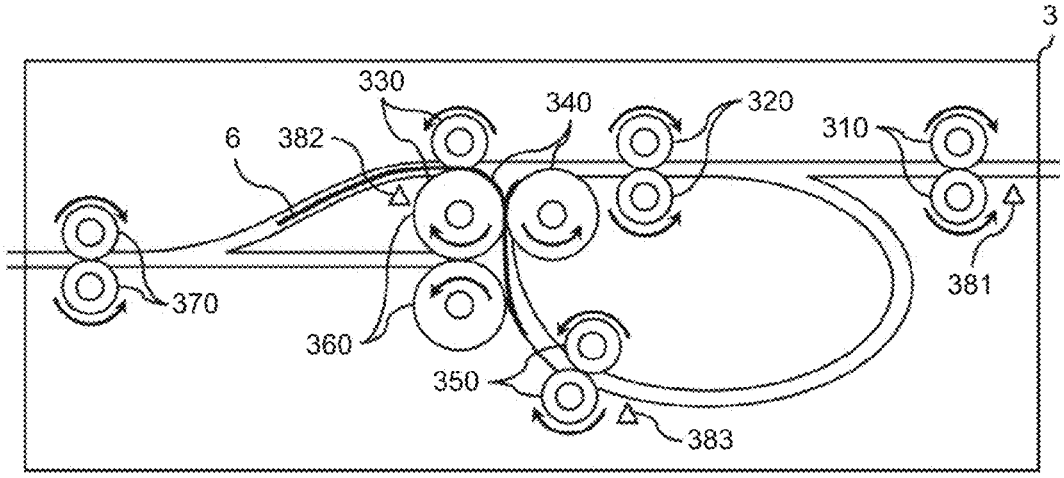
FIGS. 11A to 11C are cross-sectional views illustrating a folding processing unit performing a folding processing operation in an image forming apparatus according to an embodiment of the present invention when viewed in a direction perpendicular to a sheet conveyance direction.
Figure 11B:
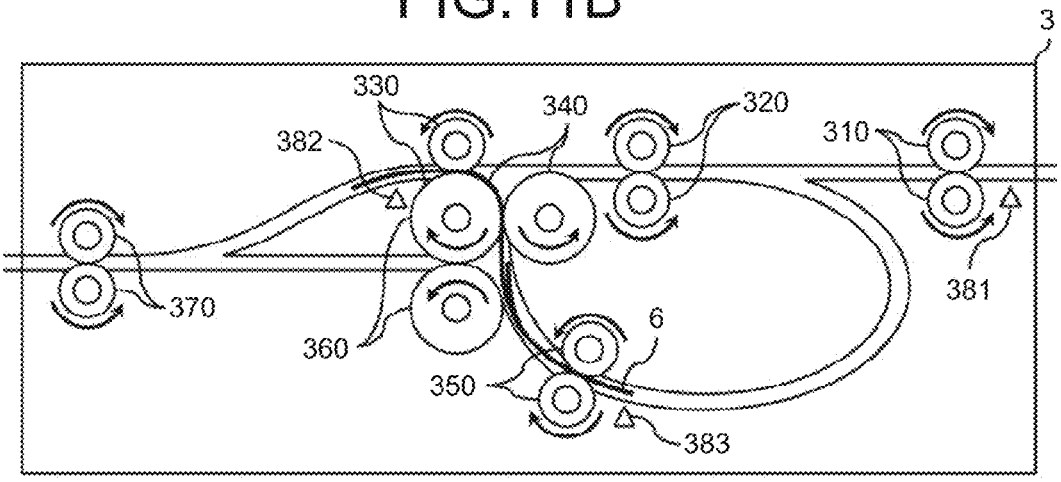
Figure 11C:
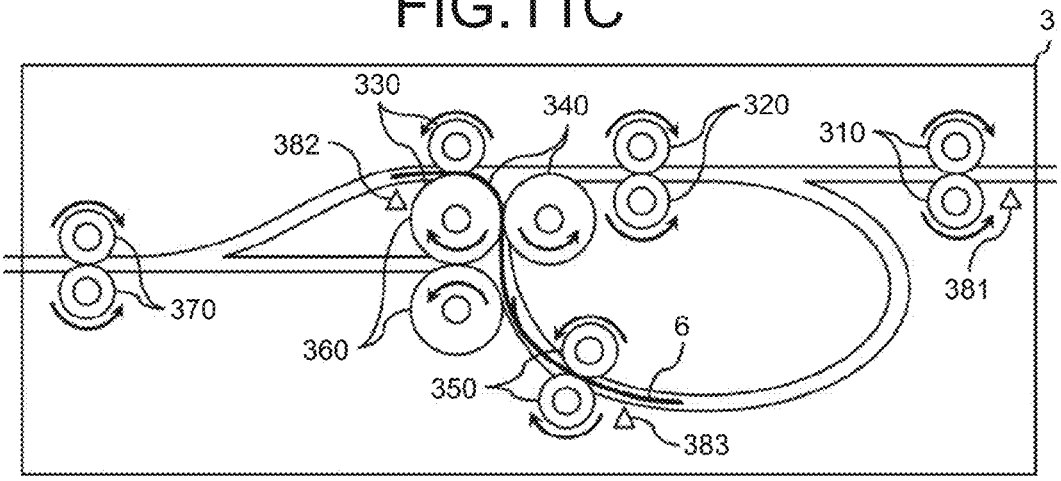
Figure 12A:
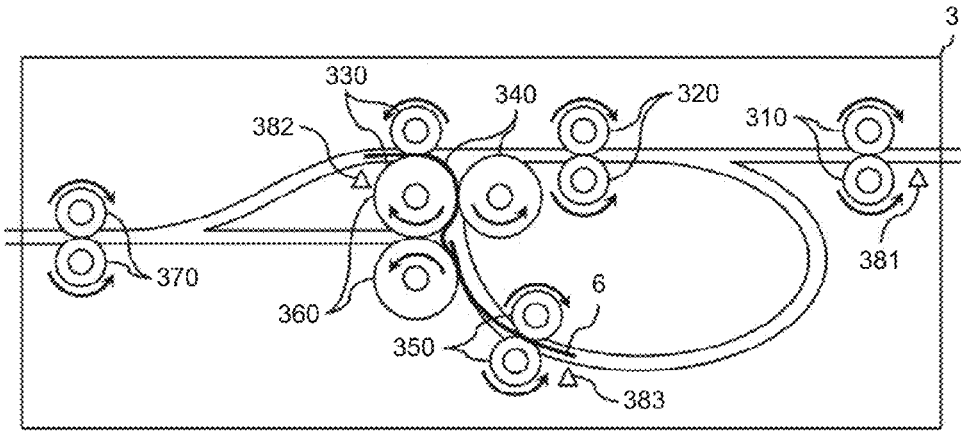
FIGS. 12A to 12C are cross-sectional views illustrating a folding processing unit performing a folding processing operation in an image forming apparatus according to an embodiment of the present invention when viewed in a direction perpendicular to a sheet conveyance direction.
Figure 12B:
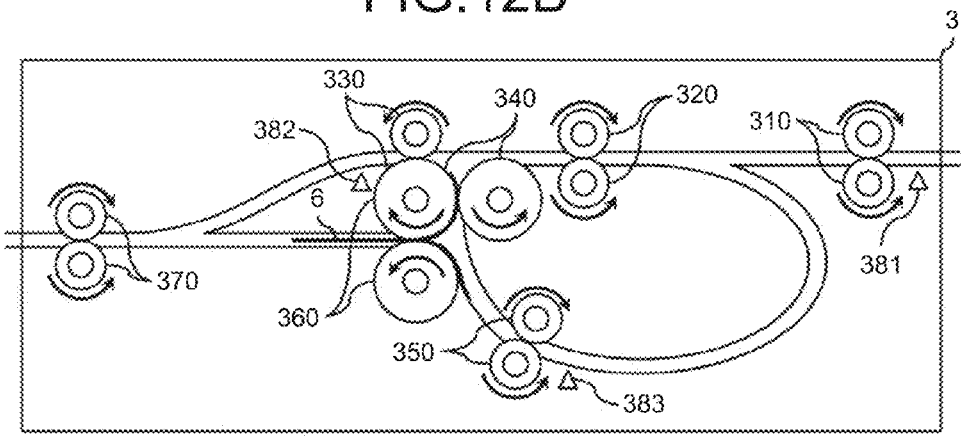
Figure 12C:
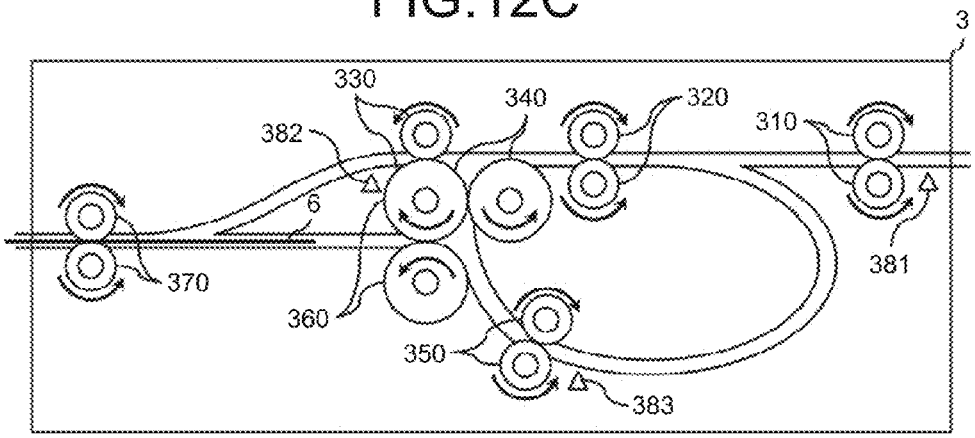

As a result of the operation illustrated in FIGS. 6A to 8C, the sheet 6 becomes a state in which the Z folding has been performed as illustrated in FIG. 9.

Figure 13:
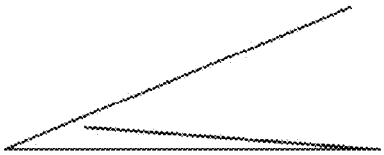
FIG. 13 is a diagram illustrating an exemplary shape of a folded sheet that has been subjected to a folding process by a folding processing unit according to an embodiment of the present invention.
Figure 14A:
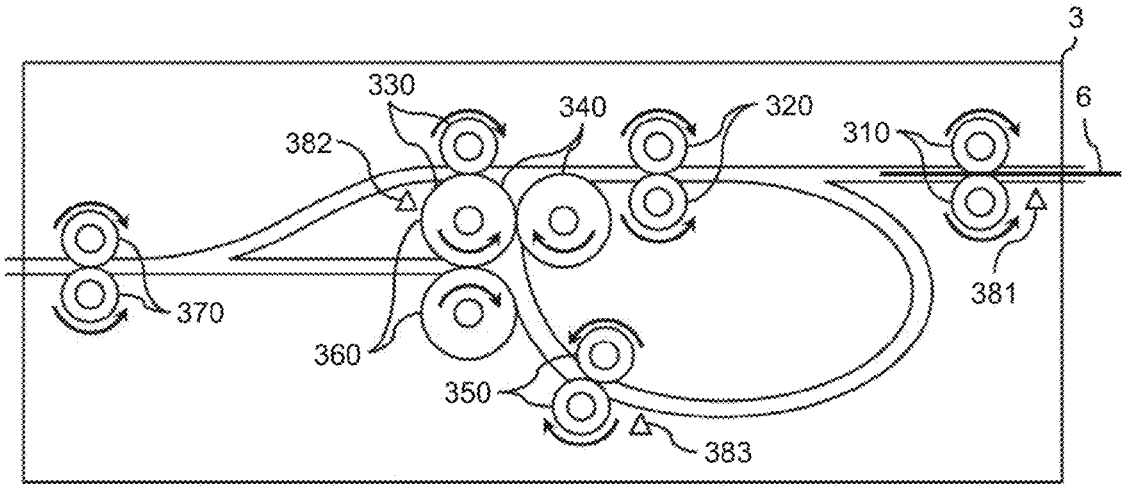
FIGS. 14A to 14C are cross-sectional views illustrating a folding processing unit performing a folding processing operation in an image forming apparatus according to an embodiment of the present invention when viewed in a direction perpendicular to a sheet conveyance direction.
Figure 14B:
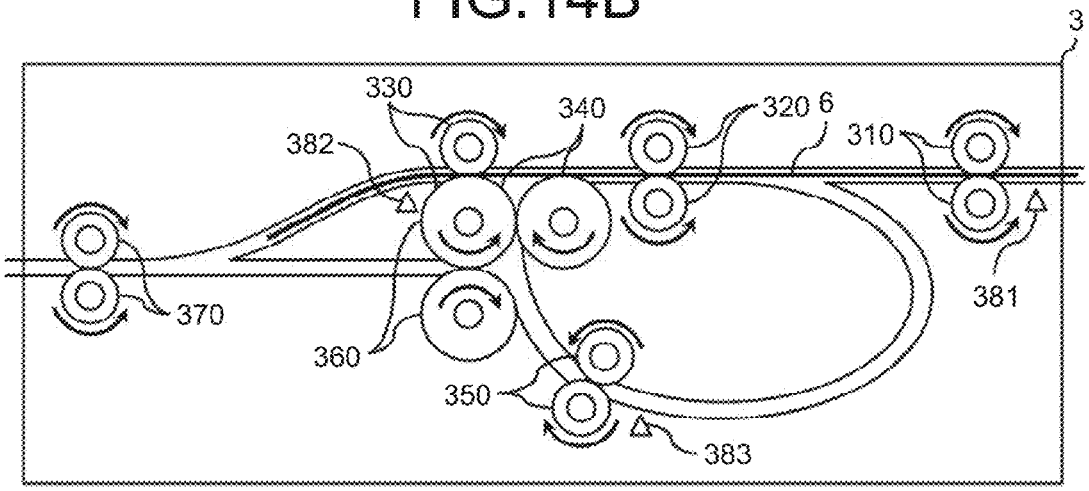
Figure 14C:
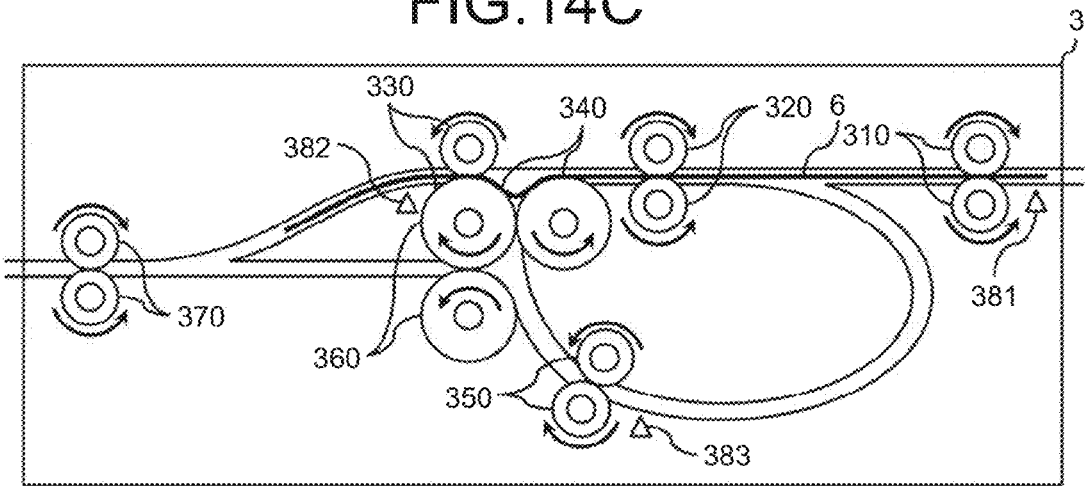
Figure 15A:
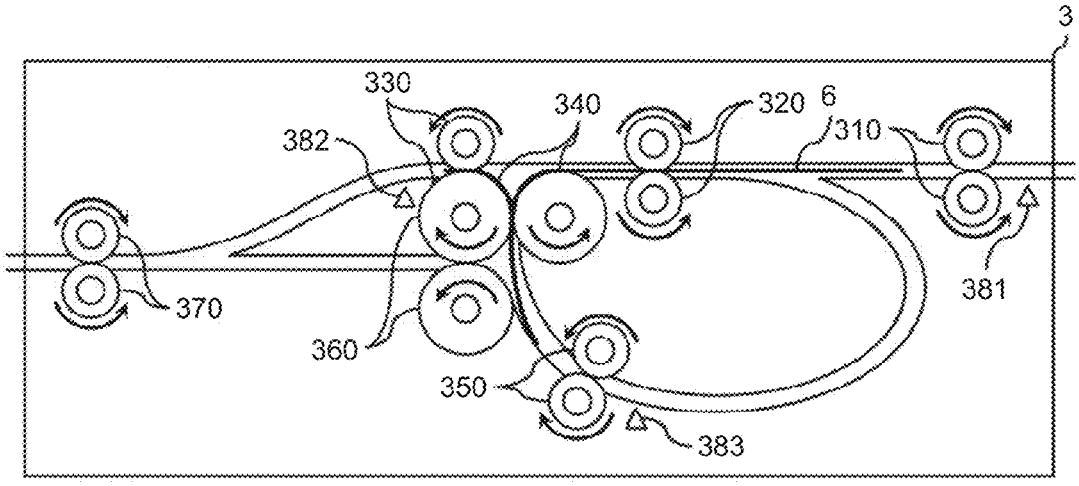
FIGS. 15A to 15C are cross-sectional views illustrating a folding processing unit performing a folding processing operation in an image forming apparatus according to an embodiment of the present invention when viewed in a direction perpendicular to a sheet conveyance direction.
Figure 15B:
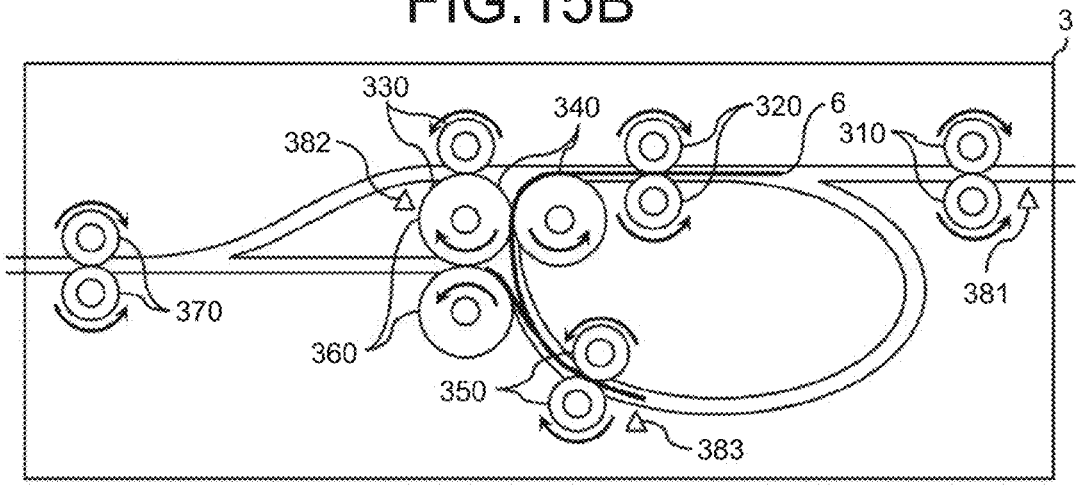
Figure 15C:
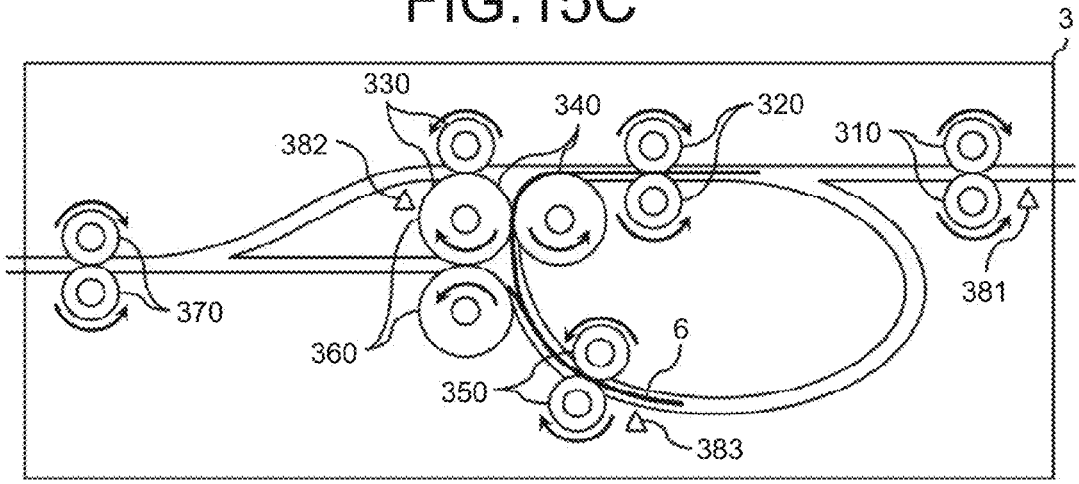
Figure 16A:
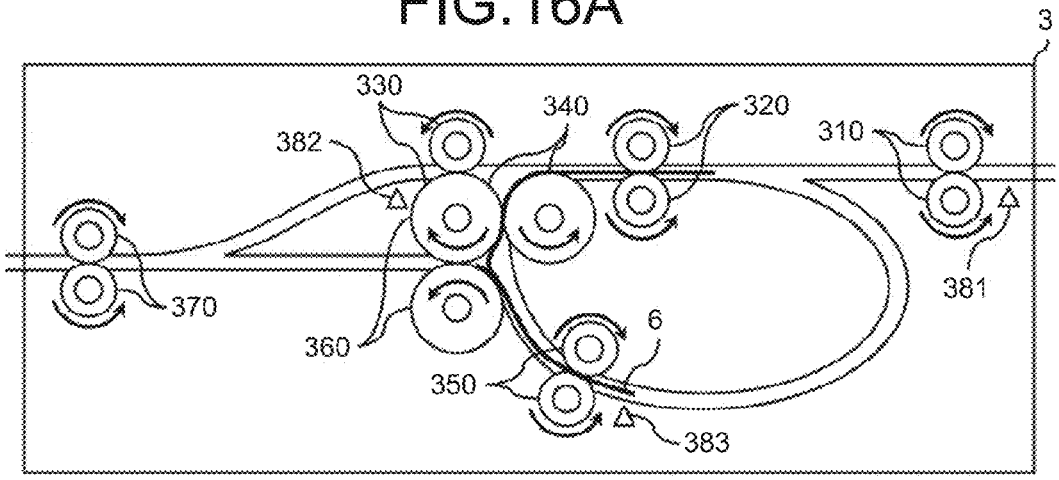
FIGS. 16A to 16C are cross-sectional views illustrating a folding processing unit performing a folding processing operation in an image forming apparatus according to an embodiment of the present invention when viewed in a direction perpendicular to a sheet conveyance direction.
Figure 16B:
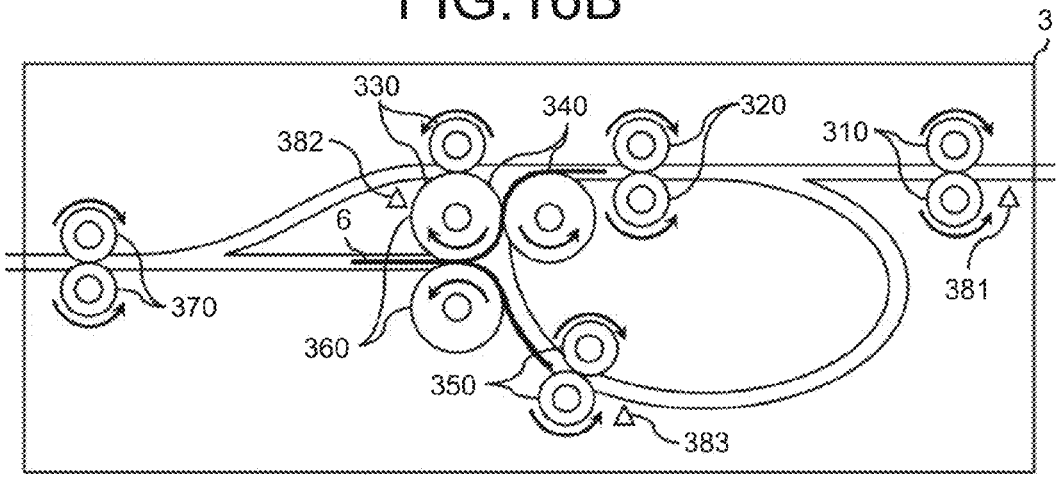
Figure 16C:
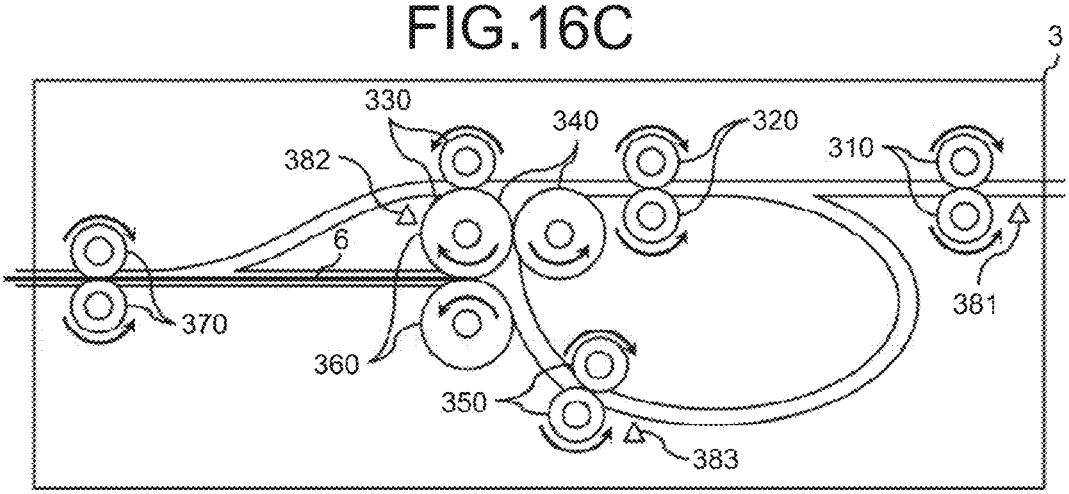

The exemplary operation when the folding processing unit 3 performs the Z folding on the sheet 6 has been described with reference to FIGS. 6A to 8C. Besides, the folding processing unit 3 can also perform inside triple folding on the sheet 6 through an operation illustrated in FIGS. 10A to 12C. As a result of the operation illustrated in FIGS. 10A to 12C, the sheet 6 becomes a state in which the inside triple folding has been performed as illustrated in FIG. 13.

Figure 17:
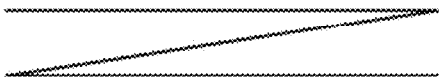
FIG. 17 is a diagram illustrating an exemplary shape of a folded sheet that has been subjected to a folding process by a folding processing unit according to an embodiment of the present invention.

Besides, the folding processing unit 3 can also perform outside triple folding on the sheet 6 through an operation illustrated in FIGS. 14A to 16C. As a result of the operation illustrated in FIGS. 14A to 16C, the sheet 6 becomes a state in which outside triple folding has been performed as illustrated in FIG. 17.

This operation is the same as the operation described with reference to FIGS. 6A to 8C, but the distances S1 and S2 differ in each operation. Thus, the folding processing unit 3 causes timings at which the rotation directions of the first forward-reverse rotating roller pair 330 and the second forward-reverse rotating roller pair 350 are reversed to differ in each operation.

Figure 18A:
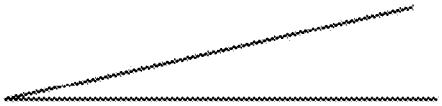
FIGS. 18A and 18B are diagrams illustrating exemplary shapes of a folded sheet that has been subjected to a folding process by a folding processing unit according to an embodiment of the present invention.
Figure 18B:
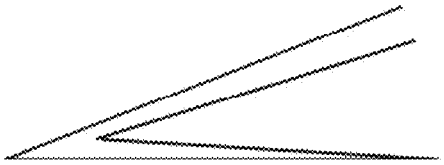

Further, in addition to the above folding methods, the folding processing unit 3 according to the present embodiment can also perform folding methods illustrated in FIGS. 18A and 18B by changing an operation according to a folding method.

Figure 19:
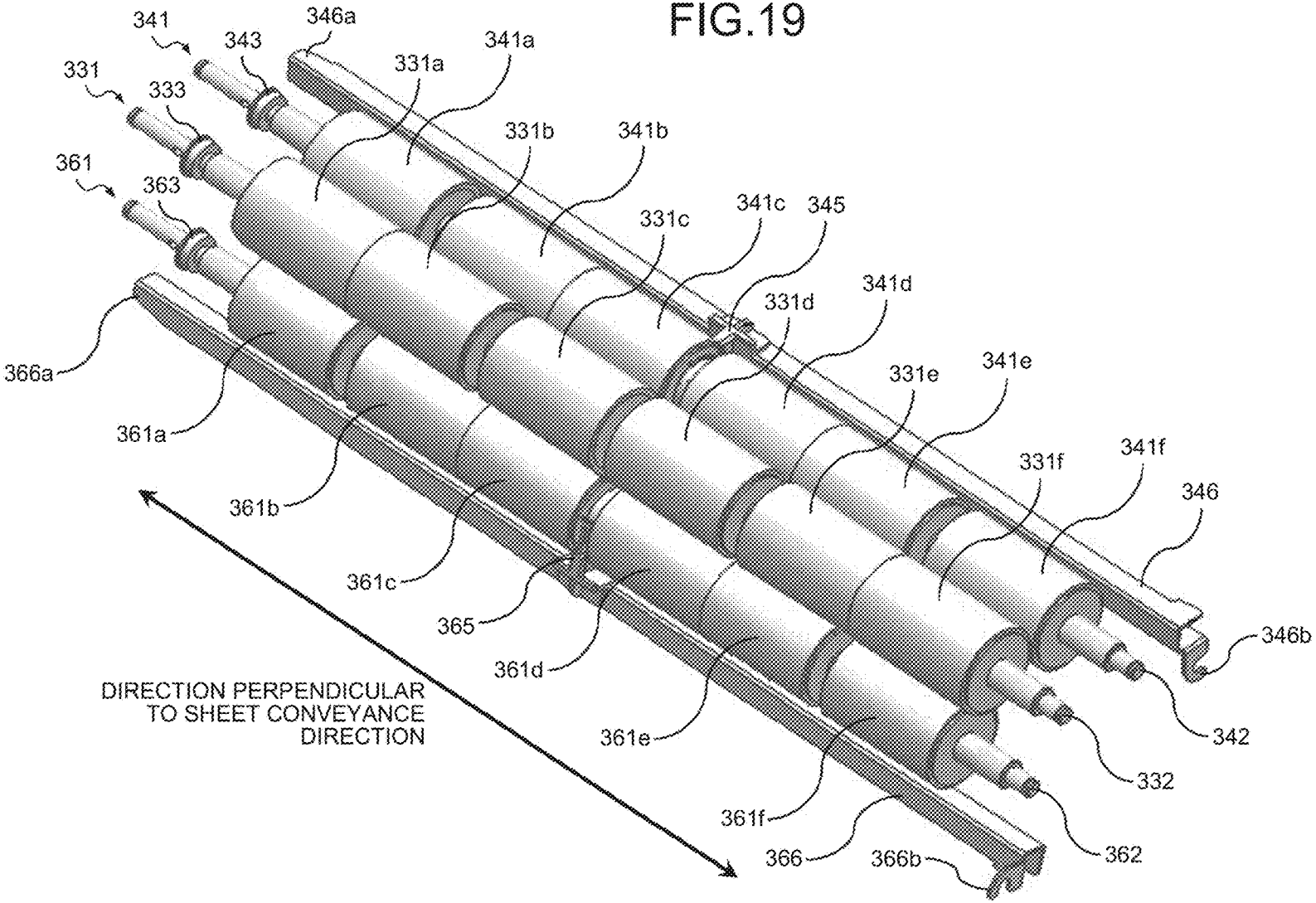
FIG. 19 is a perspective view illustrating a first forward-reverse rotating roller, a first folding processing roller, and a second folding processing roller in a folding processing unit according to an embodiment of the present invention.
Figure 20:
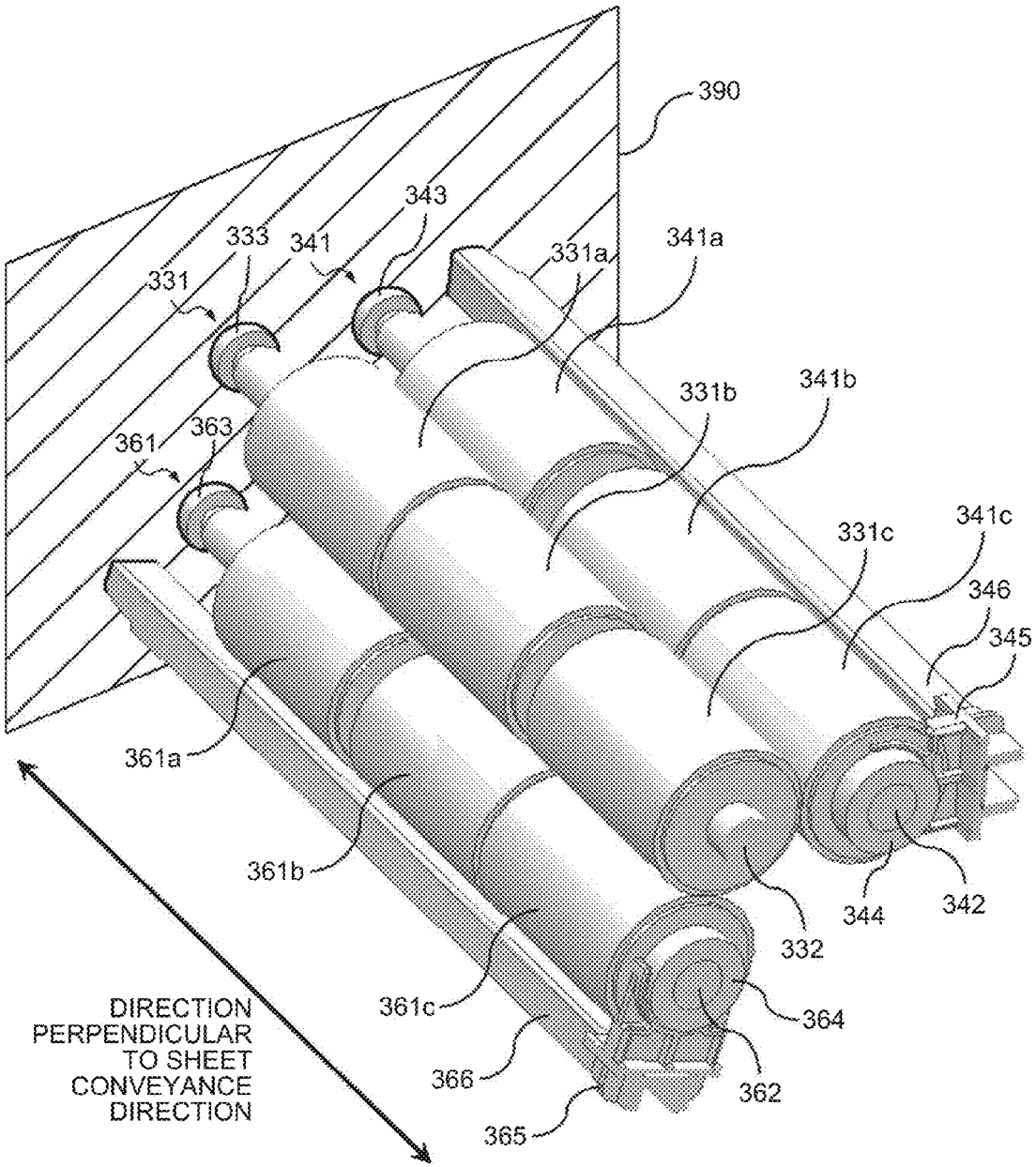
FIG. 20 is a perspective view illustrating a first forward-reverse rotating roller, a first folding processing roller, and a second folding processing roller in a folding processing unit according to an embodiment of the present invention that are cut in a central portion in a direction perpendicular to a sheet conveyance direction.
Figure 21:
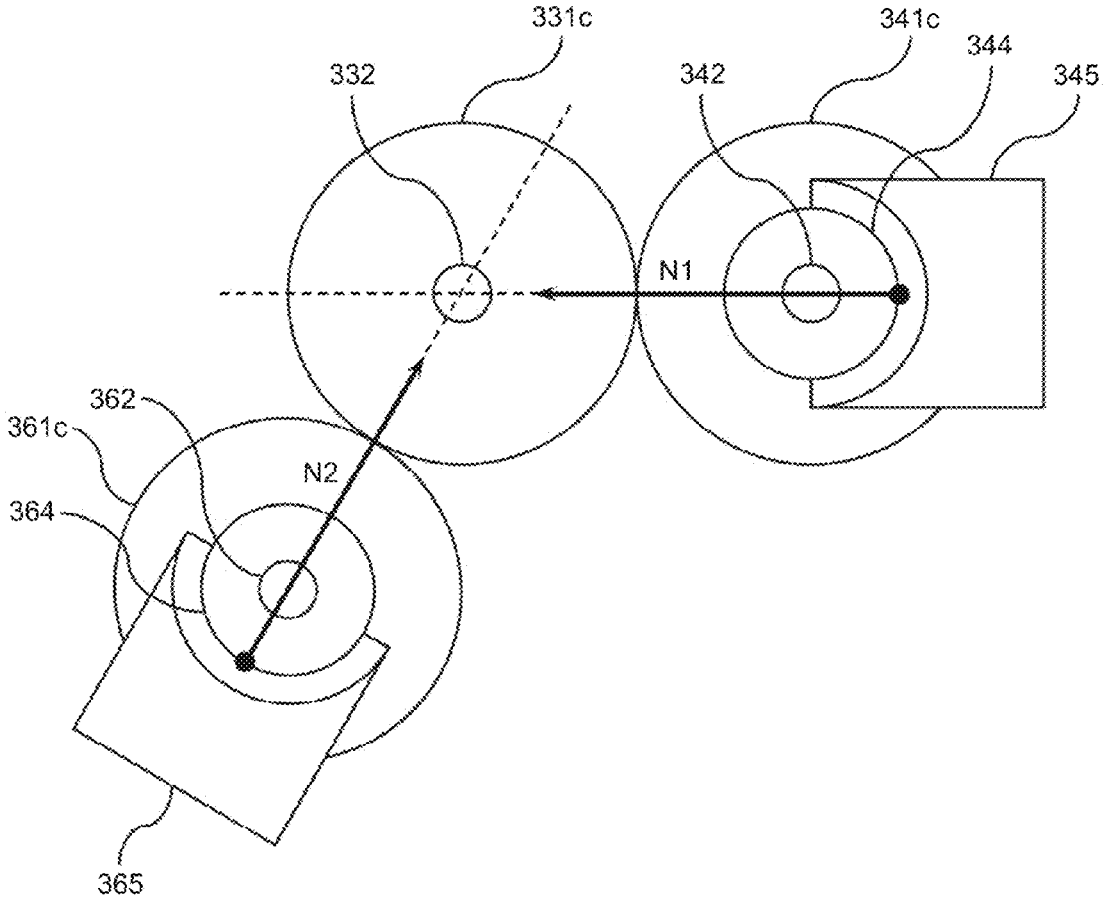
FIG. 21 is a cross-sectional view illustrating a first forward-reverse rotating roller, a first folding processing roller, and a second folding processing roller in a central portion in a direction perpendicular to a sheet conveyance direction in a folding processing unit according to an embodiment of the present invention when viewed in the direction perpendicular to the sheet conveyance direction.

Next, structures of the first forward-reverse rotating roller 331, the first folding processing roller 341, and the second folding processing roller 361 in the folding processing unit 3 according to the present embodiment will be described with reference to FIGS. 19 to 21. FIG. 19 is a perspective view illustrating the first forward-reverse rotating roller 331, the first folding processing roller 341, and the second folding processing roller 361 in the folding processing unit 3 according to the present embodiment. FIG. 20 is a perspective view illustrating the first forward-reverse rotating roller 331, the first folding processing roller 341, and the second folding processing roller 361 in the folding processing unit 3 according to the present embodiment that are cut in a central portion in a direction perpendicular to a sheet conveyance direction. FIG. 21 is a cross-sectional view illustrating the central portion of the first forward-reverse rotating roller 331, the first folding processing roller 341, and the second folding processing roller 361 in the direction perpendicular to the sheet conveyance direction in the folding processing unit 3 according to the present embodiment when viewed in the direction perpendicular to the sheet conveyance direction.

As illustrated in FIG. 19, the first forward-reverse rotating roller 331 according to the present embodiment is configured with six rollers, that is, a first forward-reverse rotating roller 331*a*, a first forward-reverse rotating roller 331*b*, a first forward-reverse rotating roller 331*c*, a first forward-reverse rotating roller 331*d*, a first forward-reverse rotating roller 331*e*, and a first forward-reverse rotating roller 331*f* having the same size, shape, and structure.

The first folding processing roller 341 according to the present embodiment is configured with six rollers, that is, a first folding processing roller 341*a*, a first folding processing roller 341*b*, a first folding processing roller 341*c*, a first folding processing roller 341*d*, a first folding processing roller 341*e*, and a first folding processing roller 341*f* having the same size, shape, and structure.

The second folding processing roller 361 according to the present embodiment is configured with six rollers, that is, a second folding processing roller 361*a*, a second folding processing roller 361*b*, a second folding processing roller 361*c*, a second folding processing roller 361*d*, a second folding processing roller 361*e*, and a second folding processing roller 361*f* having the same size, shape, and structure.

Since each of the first forward-reverse rotating roller 331, the first folding processing roller 341, and the second folding processing roller 361 according to the present embodiment is configured with a plurality of rollers having the same size, shape, and structure as described above, it is possible to reduce the manufacturing cost of the first forward-reverse rotating roller 331, the first folding processing roller 341, and the second folding processing roller 361. Here, each of the first forward-reverse rotating roller 331, the first folding processing roller 341, and the second folding processing roller 361 is configured with the same type of rollers having the same size, shape, and structure, but it is possible to further reduce the manufacturing cost of each roller by using a common type of roller between rollers.

In the first forward-reverse rotating roller 331 according to the present embodiment, gaps are formed in the revolving direction at three positions, that is, between the first forward-reverse rotating roller 331*b* and the first forward-reverse rotating roller 331*c*, between the first forward-reverse rotating roller 331*c* and the first forward-reverse rotating roller 331*d*, and between the first forward-reverse rotating roller 331*d* and the first forward-reverse rotating roller 331*e*.

In the first folding processing roller 341 according to the present embodiment, gaps are formed in the revolving direction at three positions, that is, between the first folding processing roller 341*a* and the first folding processing roller 341*b*, between the first folding processing roller 341*c* and the first folding processing roller 341*d*, and between the first folding processing roller 341*e* and the first folding processing roller 341*f*.

In the second folding processing roller 361 according to the present embodiment, gaps are formed in the revolving direction at three positions, that is, between the second folding processing roller 361*a* and the second folding processing roller 361*b*, between the second folding processing roller 361*c* and the second folding processing roller 361*d*, and between the second folding processing roller 361*e* and the second folding processing roller 361*f*.

The gap is formed in the revolving direction between the configured rollers in each of the first forward-reverse rotating roller 331, the first folding processing roller 341, and the second folding processing roller 361 according to the present embodiment as described above, and thus it is possible to prevent the folding quality from being lowered because a sheet is misdirected and so a wrinkle or a skew occurs or a folding position is deviated. Here, in this configuration, there is a portion that is not pressed due to the gap formed in the first folding processing roller 341. In this regard, the position of the gap formed in the first folding processing roller 341 in the direction perpendicular to the sheet conveyance direction is adjusted to be different from the position of the gap formed in the second folding processing roller 361 in the direction perpendicular to the sheet conveyance direction, and thus the portion that is not pressed due to the gap is pressed by the second folding processing roller pair 360, and thus a folding line can be formed effectively.

The first forward-reverse rotating roller 331, the first folding processing roller 341, and the second folding processing roller 361 having the above configuration are fixed such that a first forward-reverse rotating roller bearing 333, a first folding processing roller bearing 343, and a second folding processing roller bearing 363 are supported by shaft holes formed in a support plate 390 installed vertically to both ends in the direction perpendicular to the sheet conveyance direction and laterally bridged in the direction perpendicular to the sheet conveyance direction as illustrated in FIG. 20. Here, FIG. 20 illustrates only one end in the direction perpendicular to the sheet conveyance direction, and the other end is similarly fixed. In other words, in the present embodiment, the support plate 390 and a support plate arranged at the position opposite to the support plate 390 function as a support unit.

Further, in the first folding processing roller 341 according to the present embodiment, a groove is formed in the revolving direction between the first folding processing roller 341*c* and the first folding processing roller 341*d*, that is, in the central portion in the direction perpendicular to the sheet conveyance direction as illustrated in FIG. 20. Further, in the first folding processing roller 341 according to the present embodiment, a bearing 344 is mounted in the groove to slide on an outer circumference of a first folding processing roller rotating shaft 342 serving as a rotating shaft of the first folding processing roller 341 as illustrated in FIG. 20. A first folding processing roller pressing member 345 fixed to a first folding processing roller pressing member fixing stay 346 is mounted on the bearing 344 to grip the outer circumference of the bearing 344.

Figure 22:
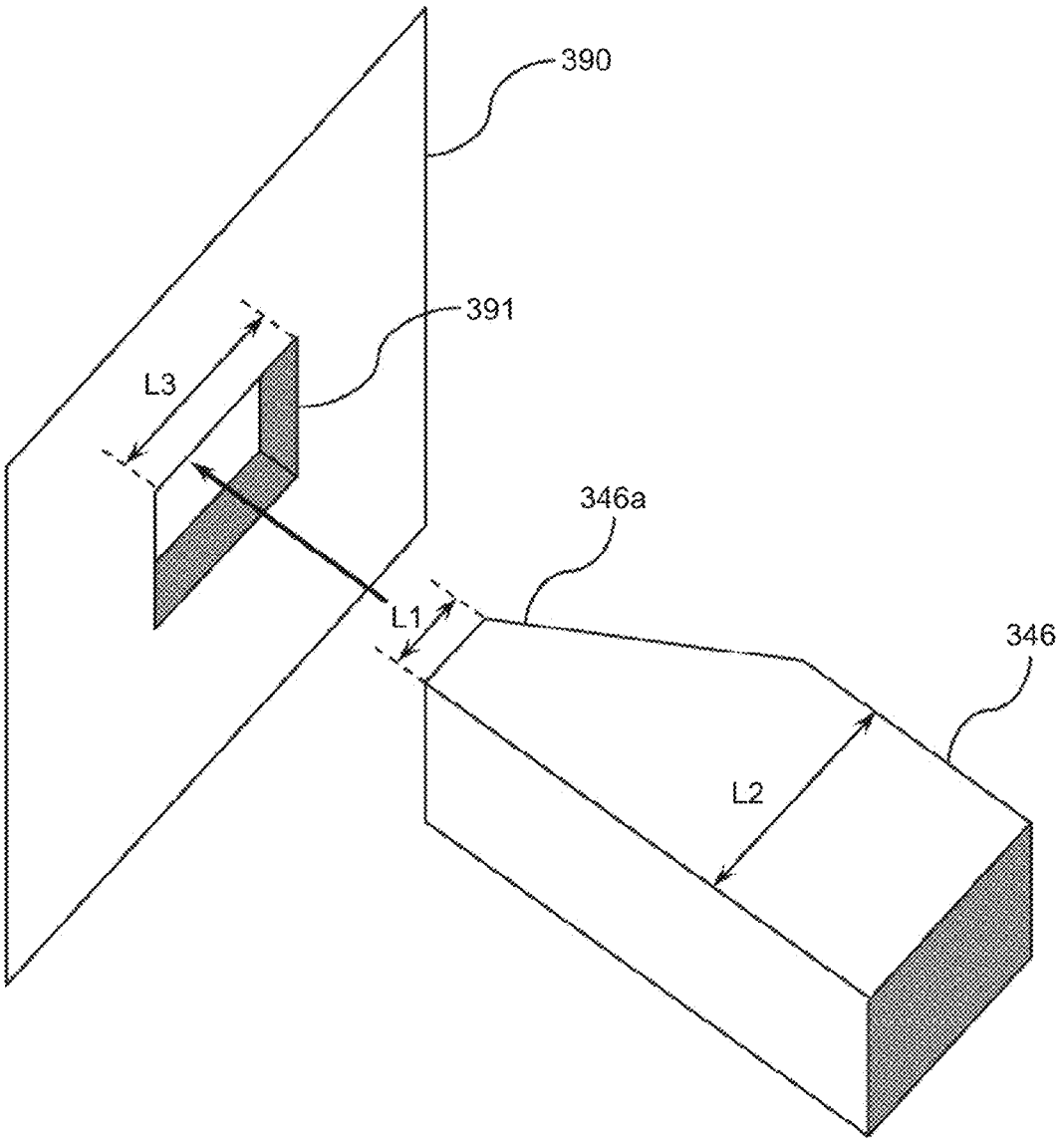
FIG. 22 is a diagram for describing a state in which a first folding processing roller pressing member fixing stay is fixed to a support plate according to an embodiment of the present invention.

Here, a state in which the first folding processing roller pressing member fixing stay 346 is fixed to the support plate 390 according to the present embodiment will be described with reference to FIG. 22. FIG. 22 is a diagram for describing a state in which the first folding processing roller pressing member fixing stay 346 is fixed to the support plate 390 according to the present embodiment.

The first folding processing roller pressing member fixing stay 346 according to the present embodiment includes an insertion portion 346*a* formed at one end thereof in the direction perpendicular to the sheet conveyance direction as illustrated in FIG. 22. The insertion portion 346*a* is configured to taper such that a width L1 of a leading edge is smaller than a width L2 of a body portion. The first folding processing roller pressing member fixing stay 346 according to the present embodiment further includes a fixing portion 346*b* formed at the other end in the direction perpendicular to the sheet conveyance direction as illustrated in FIG. 19. Further, an insertion hole 391 having a width L3 satisfying L1<L3<L2 is formed in the support plate 390.

In the first folding processing roller pressing member fixing stay 346 according to the present embodiment, the fixing portion 346*b* of the other end is fixed to the support plate 390 installed at the side opposite to the support plate 390 by a screw in the state in which the insertion portion 346*a* is inserted into the insertion hole 391. Thus, the first folding processing roller pressing member fixing stay 346 according to the present embodiment is fixed such that the first folding processing roller pressing member fixing stay 346 is supported by the support plate 390 installed vertically to both ends in the direction perpendicular to the sheet conveyance direction and laterally bridged in the direction perpendicular to the sheet conveyance direction.

As the first folding processing roller pressing member fixing stay 346 is fixed as described above, the first folding processing roller pressing member 345 applies force N1 toward the rotational center of the first forward-reverse rotating roller 331 through the first folding processing roller pressing member fixing stay 346 as illustrated in FIG. 21. Thus, the first folding processing roller pressing member 345 firmly presses the first folding processing roller 341 against the first forward-reverse rotating roller 331 through the bearing 344 and the first folding processing roller rotating shaft 342 by the force N1.

Here, as illustrated in FIG. 22, in the first folding processing roller pressing member fixing stay 346 according to the present embodiment, the insertion portion 346*a* is formed at one end in the direction perpendicular to the sheet conveyance direction, the insertion portion 346*a* is configured to taper, and the width L1 of the leading edge is smaller than the width L2 of the body portion. Thus, in the folding processing unit 3 according to the present embodiment, it is possible to adjust the magnitude of the force N1 by adjusting the length in which the insertion portion 346*a* is inserted into the insertion hole 391.

At this time, since the first forward-reverse rotating roller 331 and the first folding processing roller 341 are fixed to the support plate 390 installed vertically to both ends in the direction perpendicular to the sheet conveyance direction as described above, the first folding processing roller 341 and the first forward-reverse rotating roller 331 are pressed firmly by uniform force acting over the whole area in the direction perpendicular to the sheet conveyance direction. Thus, the folding processing unit 3 according to the present embodiment can press the sheet from the sheet surfaces in the nip portion between the first forward-reverse rotating roller 331 and the first folding processing roller 341 by uniform pressing force acting over the whole area in the direction perpendicular to the sheet conveyance direction. Thus, the folding processing unit 3 according to the present embodiment can effectively form a folding line even on a sheet in which the width in the direction perpendicular to the sheet conveyance direction is large over the whole area of the sheet.

Similarly to the first folding processing roller 341, the second folding processing roller 361 according to the present embodiment is configured to apply force of firmly pressing the second folding processing roller 361 against the first forward-reverse rotating roller 331 in the central portion of the second folding processing roller 361.

Specifically, in the second folding processing roller 361 according to the present embodiment, the groove is formed in the revolving direction between the second folding processing roller 361*c* and the second folding processing roller 361*d*, that is, in the central portion in the direction perpendicular to the sheet conveyance direction as illustrated in FIG. 20. Further, as illustrated in FIG. 20, in the second folding processing roller 361 according to the present embodiment, a bearing 364 is mounted in the groove to slide on an outer circumference of a second folding processing roller rotating shaft 362 serving as a rotating shaft of the second folding processing roller 361 as illustrated in FIG. 20. A second folding processing roller pressing member 365 fixed to a second folding processing roller pressing member fixing stay 366 is mounted on the bearing 364 to grip the outer circumference of the bearing 364.

A second folding processing roller pressing member 365 has a similar configuration to that of the first folding processing roller pressing member 345 described with reference to FIG. 21. Similarly to the first folding processing roller pressing member fixing stay 346 described above with reference to FIG. 22, the second folding processing roller pressing member fixing stay 366 according to the present embodiment is fixed such that the second folding processing roller pressing member fixing stay 366 is supported by the support plate 390 installed vertically to both ends in the direction perpendicular to the sheet conveyance direction and laterally bridged in the direction perpendicular to the sheet conveyance direction.

As the second folding processing roller pressing member fixing stay 366 is fixed as described above, the second folding processing roller pressing member 365 applies force N2 toward the rotational center of the first forward-reverse rotating roller 331 through the second folding processing roller pressing member fixing stay 366 as illustrated in FIG. 21. Thus, the second folding processing roller pressing member 365 firmly presses the second folding processing roller 361 against the first forward-reverse rotating roller 331 through the bearing 364 and the second folding processing roller rotating shaft 362 by the force N2.

Here, as described above, the second folding processing roller pressing member fixing stay 366 according to the present embodiment has a similar configuration to that of the first folding processing roller pressing member fixing stay 346. Thus, in the folding processing unit 3 according to the present embodiment, it is possible to adjust the magnitude of the force N2 by adjusting the length in which the second folding processing roller pressing member fixing stay 366 is inserted into the insertion hole.

At this time, since the first forward-reverse rotating roller 331 and the second folding processing roller 361 are fixed to the support plate 390 installed vertically to both ends in the direction perpendicular to the sheet conveyance direction as described above, the second folding processing roller 361 and the first forward-reverse rotating roller 331 are pressed firmly by uniform force acting over the whole area in the direction perpendicular to the sheet conveyance direction. Thus, the folding processing unit 3 according to the present embodiment can press the sheet from the sheet surfaces in the nip portion between the first forward-reverse rotating roller 331 and the second folding processing roller 361 by uniform pressing force acting over the whole area in the direction perpendicular to the sheet conveyance direction. Thus, the folding processing unit 3 according to the present embodiment can effectively form a folding line even on a sheet in which the width in the direction perpendicular to the sheet conveyance direction is large over the whole area of the sheet.

As one of the gists, as described above, the folding processing unit 3 according to the present embodiment applies force of firmly pressing the first folding processing roller 341 against the first forward-reverse rotating roller 331 in the central portion of the first folding processing roller 341, and applies force of firmly pressing the second folding processing roller 361 against the first forward-reverse rotating roller 331 in the central portion of the second folding processing roller 361. As a result, the folding processing unit 3 according to the present embodiment can generate sufficient pressing force evenly over the whole area in the direction perpendicular to the sheet conveyance direction. Thus, the folding processing unit 3 according to the present embodiment can form a folding line on a sheet effectively and improve a folding quality.

Here, the present embodiment has been described in connection with the example in which the first folding processing roller pressing member 345 is mounted to the first folding processing roller rotating shaft 342 of the first folding processing roller 341 through the bearing 344 to slide on the outer circumference of the first folding processing roller rotating shaft 342, but the first folding processing roller pressing member 345 may be mounted directly to the first folding processing roller rotating shaft 342.

In the case of this configuration, when the force N1 is applied from the first folding processing roller pressing member 345 toward a first forward-reverse rotating roller rotating shaft 332, the rotation of the first folding processing roller 341 is hindered by friction in a contact portion between the first folding processing roller rotating shaft 342 and the first folding processing roller pressing member 345, and the contact portion between the first folding processing roller rotating shaft 342 and the first folding processing roller pressing member 345 is worn.

In this regard, in the first folding processing roller 341 according to the present embodiment, the bearing 344 is mounted to the first folding processing roller rotating shaft 342 to slide on the outer circumference of the first folding processing roller rotating shaft 342, and thus the above problem can be prevented.

Similarly, the present embodiment has been described in connection with the example in which the second folding processing roller pressing member 365 is mounted to the second folding processing roller rotating shaft 362 of the second folding processing roller 361 through the bearing 364 to slide on the outer circumference of the second folding processing roller rotating shaft 362, but the second folding processing roller pressing member 365 may be mounted directly to the second folding processing roller rotating shaft 362.

In the case of this configuration, when the force N2 is applied from the second folding processing roller pressing member 365 toward the first forward-reverse rotating roller rotating shaft 332, the rotation of the second folding processing roller 361 is hindered by friction in a contact portion between the second folding processing roller rotating shaft 362 and the second folding processing roller pressing member 365, and the contact portion between the second folding processing roller rotating shaft 362 and the second folding processing roller pressing member 365 is worn.

In this regard, in the second folding processing roller 361 according to the present embodiment, the bearing 364 is mounted to the second folding processing roller rotating shaft 362 to slide on the outer circumference of the second folding processing roller rotating shaft 362, and thus the above problem can be prevented.

Figure 23:
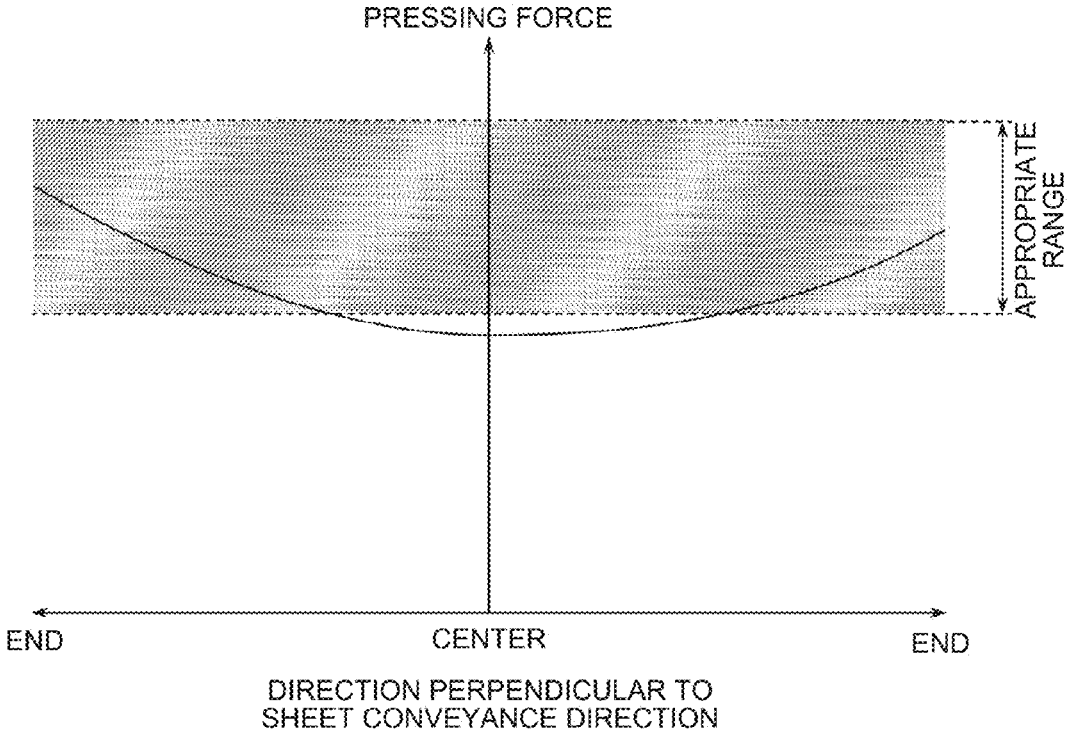
FIG. 23 is a diagram illustrating a pressing force distribution in a direction perpendicular to a sheet conveyance direction when a folding processing unit according to a related art presses a sheet through a first folding processing roller pair or a second folding processing roller pair.
Figure 24:
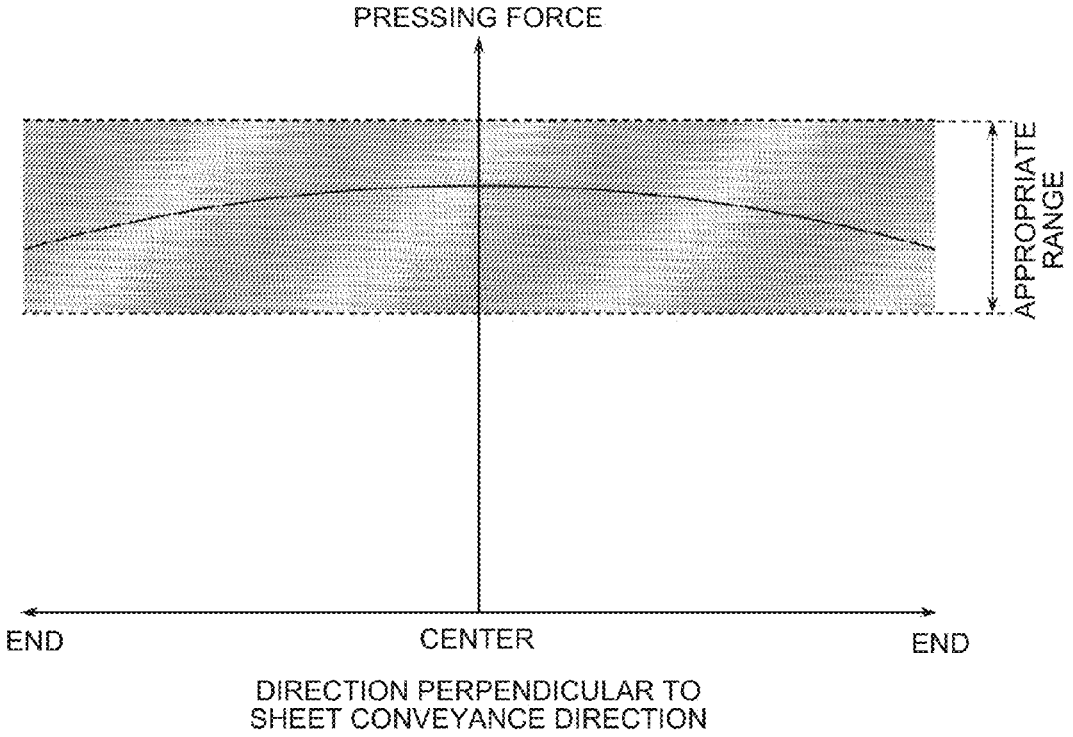
FIG. 24 is a diagram illustrating a pressing force distribution in a direction perpendicular to a sheet conveyance direction when a folding processing unit according to an embodiment of the present invention presses a sheet through a first folding processing roller pair or a second folding processing roller pair.

Here, effects of the folding processing unit 3 according to the present embodiment will be described in detail with reference to FIGS. 23 and 24. FIG. 23 is a diagram illustrating a pressing force distribution in the direction perpendicular to the sheet conveyance direction when the folding processing unit 3 according to the related art presses the sheet through the folding processing roller pair. FIG. 24 is a diagram illustrating a pressing force distribution in the direction perpendicular to the sheet conveyance direction when the folding processing unit 3 according to the present embodiment presses the sheet through the first folding processing roller pair 340 or the second folding processing roller pair 360.

The folding processing unit according to the related art is configured to cause force for pressing the two folding processing rollers configuring the folding processing roller pair against each other to act on both ends in the direction perpendicular to the sheet conveyance direction.

Thus, in the folding processing unit according to the related art, the repulsive force is generated from the sheet being pressed against the folding processing roller, but since force for pressing the folding processing rollers against each other acts on near both ends in the direction perpendicular to the sheet conveyance direction, it is possible to counter the repulsive force. On the other hand, in the folding processing unit according to the related art, since force countering the repulsive force does not act on near the central portion in the direction perpendicular to the sheet conveyance direction, a portion near the central portion of the folding processing roller is bent in a direction opposite to the pressing direction.

Thus, as illustrated in FIG. 23, in the folding processing unit according to the related art, it is possible to secure sufficient pressing force near both ends in the direction perpendicular to the sheet conveyance direction, but it is difficult to secure sufficient pressing force near the central portion. As a result, in the folding processing unit according to the related art, it is difficult to effectively press the sheet near the central portion in the direction perpendicular to the sheet conveyance direction.

Further, in the folding processing unit according to the related art, since the force for pressing the folding processing rollers against each other is caused to act on both ends of the folding processing roller pair in the direction perpendicular to the sheet conveyance direction, a deviation of the pressing force occurs between both ends as illustrated in FIG. 23. As a result, in the folding processing unit according to the related art, a wrinkle or a skew occurs in the sheet, or the folding position is misaligned, resulting in a reduction in a folding quality.

In this regard, the folding processing unit 3 according to the present embodiment is configured so that force for pressing the first folding processing roller 341 against the first forward-reverse rotating roller 331 acts on the central portion of the first folding processing roller 341, and force for pressing the second folding processing roller 361 against the first forward-reverse rotating roller 331 acts on the central portion of the second folding processing roller 361. In other words, in the present embodiment, each of the first folding processing roller pressing member 345 and the second folding processing roller pressing member 365 functions as any one of the first pressing unit and the second pressing unit.

Thus, the folding processing unit 3 according to the present embodiment can implement a pressing force distribution that is line-symmetric in the central portion by generating strongest pressing force in the central portion in the direction perpendicular to the sheet conveyance direction as illustrated in FIG. 24. As a result, the folding processing unit 3 according to the present embodiment can generate appropriate pressing force evenly over the whole area in the direction perpendicular to the sheet conveyance direction. Thus, the folding processing unit 3 according to the present embodiment can form a folding line on a sheet effectively and improve a folding quality.

Figure 25:
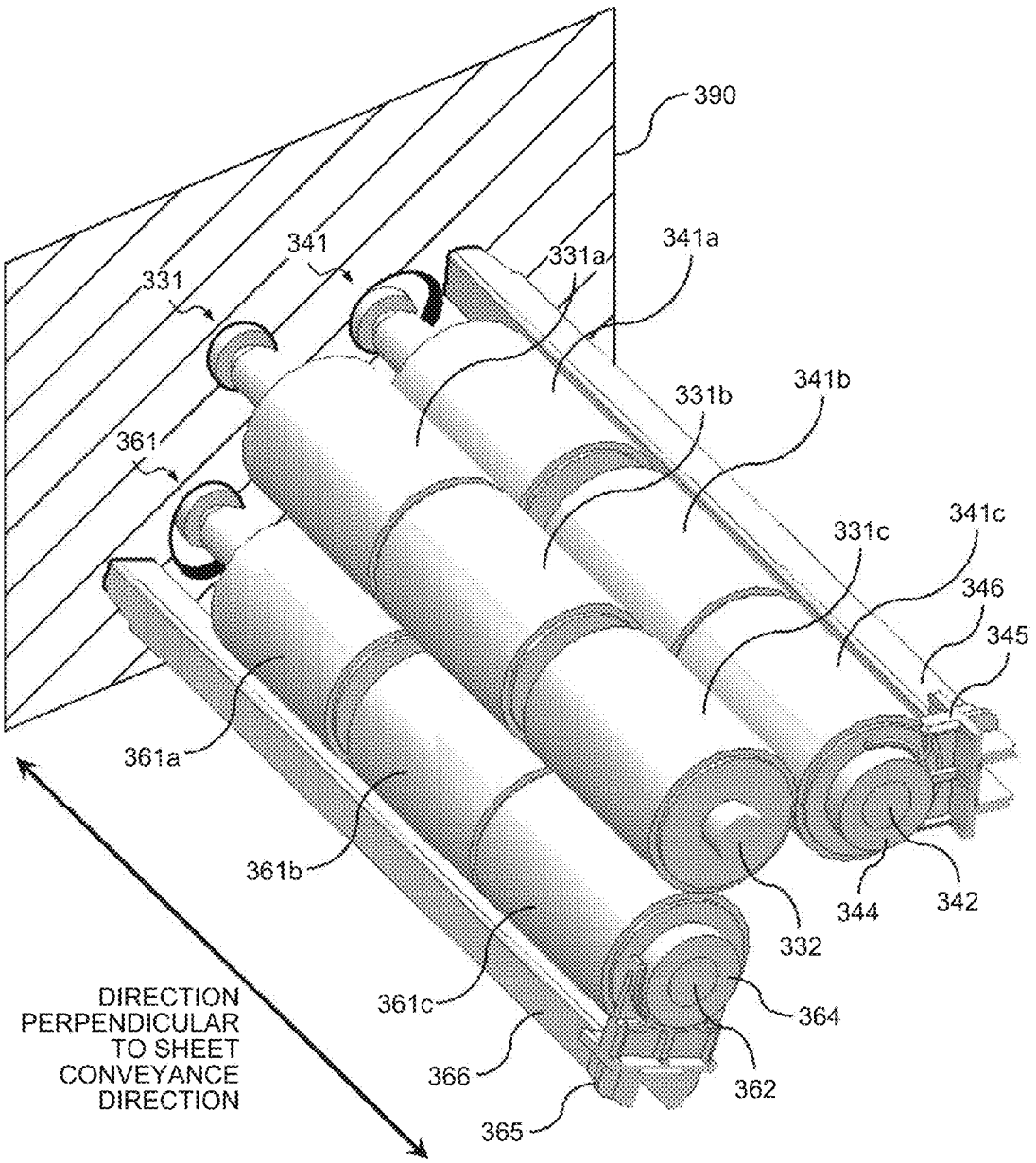
FIG. 25 is a perspective view illustrating a first forward-reverse rotating roller, a first folding processing roller, and a second folding processing roller in a folding processing unit according to an embodiment of the present invention that are cut in a central portion in a direction perpendicular to a sheet conveyance direction.

Here, the present embodiment has been described in connection with the example in which the first folding processing roller 341 and the second folding processing roller 361 are fixed such that, as illustrated in FIG. 20, the first folding processing roller bearing 343 and the second folding processing roller bearing 363 are supported by the shaft holes formed in the support plate 390 installed vertically to both ends in the direction perpendicular to the sheet conveyance direction and laterally bridged in the direction perpendicular to the sheet conveyance direction as described above with reference to FIG. 20. Besides, the shaft holes formed in the support plate 390 to support the first folding processing roller 341 and the second folding processing roller 361 may be formed as an elliptical shape that is long in the direction in which the first forward-reverse rotating roller 331 is pressed as illustrated in FIG. 25. Through this configuration, the first folding processing roller 341 and the second folding processing roller 361 are movable.

In the case of this configuration, the first folding processing roller 341 and the second folding processing roller 361 are firmly pressed against the first forward-reverse rotating roller 331 in a state in which the first folding processing roller pressing member fixing stay 346 and the second folding processing roller pressing member fixing stay 366 are fixed to the support plate 390. On the other hand, the first folding processing roller 341 and the second folding processing roller 361 are separated from the first forward-reverse rotating roller 331 in a state in which the first folding processing roller pressing member fixing stay 346 and the second folding processing roller pressing member fixing stay 366 are removed from the support plate 390. Here, FIG. 25 illustrates only one end in the direction perpendicular to the sheet conveyance direction, and the other end is similarly fixed.

Further, the present embodiment has been described in connection with the example in which the first folding processing roller pressing member 345 and the second folding processing roller pressing member 365 are mounted to the first folding processing roller 341 and the second folding processing roller 361, respectively, and the first folding processing roller 341 and the second folding processing roller 361 are firmly pressed against the first forward-reverse rotating roller 331 by the force N1 and the force N2 as described above with reference to FIG. 21.

Figure 26:
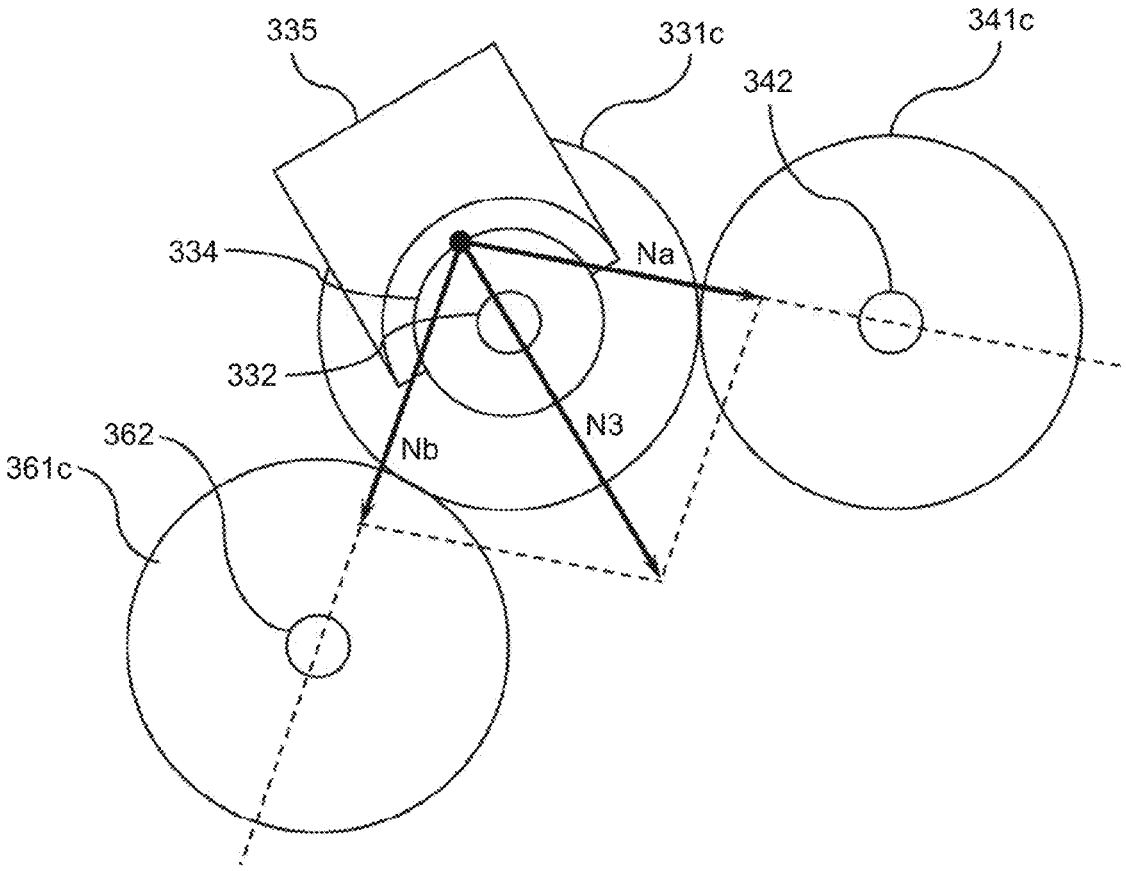
FIG. 26 is a cross-sectional view illustrating a first forward-reverse rotating roller, a first folding processing roller, and a second folding processing roller in a central portion in a direction perpendicular to a sheet conveyance direction in a folding processing unit according to an embodiment of the present invention when viewed in the direction perpendicular to the sheet conveyance direction.

Besides, as illustrated in FIG. 26, a first forward-reverse rotating roller pressing member 335 may be mounted to the first forward-reverse rotating roller 331 instead of the first folding processing roller 341 and the second folding processing roller 361. FIG. 26 is a cross-sectional view illustrating the central portion of the first forward-reverse rotating roller 331, the first folding processing roller 341, and the second folding processing roller 361 in the direction perpendicular to the sheet conveyance direction in the folding processing unit 3 according to the present embodiment when viewed in the direction perpendicular to the sheet conveyance direction.

Specifically, in the first forward-reverse rotating roller 331 according to the present embodiment, a groove is formed in the revolving direction between the first forward-reverse rotating roller 331*c* and the first forward-reverse rotating roller 331*d*, that is, in the central portion in the direction perpendicular to the sheet conveyance direction as illustrated in FIG. 26. Further, in the first forward-reverse rotating roller 331 according to the present embodiment, a bearing 334 is mounted in the groove to slide on the outer circumference of the first forward-reverse rotating roller rotating shaft 332 serving as the rotating shaft of the first forward-reverse rotating roller 331 as illustrated in FIG. 26. A first forward-reverse rotating roller pressing member 335 fixed to a first forward-reverse rotating roller pressing member fixing stay 336 is mounted on the bearing 334 to grip the outer circumference of the bearing 334.

The first forward-reverse rotating roller pressing member fixing stay 336 has a similar configuration to that of the first folding processing roller pressing member fixing stay 346 as described above with reference to FIG. 22. Further, similarly to the first folding processing roller pressing member fixing stay 346, the first forward-reverse rotating roller pressing member 335 according to the present embodiment is fixed such that the first forward-reverse rotating roller pressing member 335 is supported by the support plate 390 installed vertically to both ends in the direction perpendicular to the sheet conveyance direction and laterally bridged in the direction perpendicular to the sheet conveyance direction as described above with reference to FIG. 22. In other words, in the present embodiment, any one of the first forward-reverse rotating roller pressing member fixing stay 336, the first folding processing roller pressing member fixing stay 346, and the second folding processing roller pressing member fixing stay 366 functions as a pressing/fixing unit.

As the first forward-reverse rotating roller pressing member fixing stay 336 is fixed as described above, the first forward-reverse rotating roller pressing member 335 causes force N3 to act in a direction orthogonal to a line segment connecting the rotational center of the first folding processing roller 341 with the rotational center of the second folding processing roller 361 through the first forward-reverse rotating roller pressing member fixing stay 336 as illustrated in FIG. 26. As a result, the first forward-reverse rotating roller pressing member 335 causes force Na serving as partial pressure of the force N3 to act in the rotational center of the first folding processing roller 341, and causes force Nb serving as partial pressure of the force N3 to act in the rotational center of the second folding processing roller 361 as illustrated in FIG. 26.

Thus, the first forward-reverse rotating roller pressing member 335 firmly presses against the first forward-reverse rotating roller 331 against the first folding processing roller 341 and the second folding processing roller 361 through the bearing 334 and the first forward-reverse rotating roller rotating shaft 332 by the force Na and the force Nb. In the case of this configuration, the mechanism for firmly pressing the first forward-reverse rotating roller 331 and the first folding processing roller 341 and the mechanism for firmly pressing the first forward-reverse rotating roller 331 and the second folding processing roller 361 need not be separately equipped, and thus the number of parts can be reduced. Accordingly, it is possible to simply configure the folding processing unit 3 at a low cost.

Figure 27:
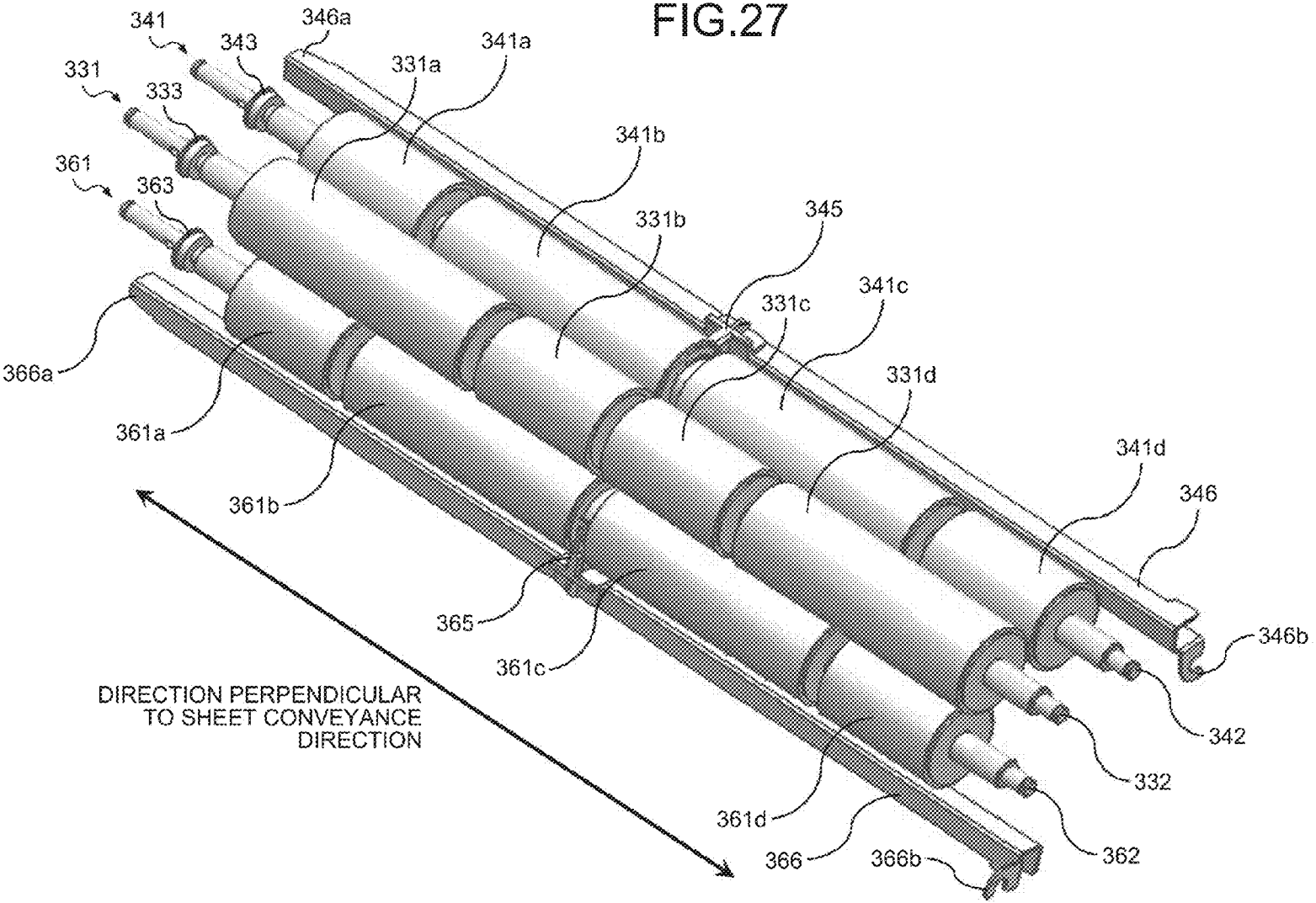
FIG. 27 is a perspective view illustrating a first forward-reverse rotating roller, a first folding processing roller, and a second folding processing roller in a folding processing unit according to an embodiment of the present invention.

Further, the present embodiment has been described in connection with the example in which each of the first forward-reverse rotating roller 331, the first folding processing roller 341, and the second folding processing roller 361 is configured with a plurality of rollers having the same size, shape, and structure as described above with reference to FIG. 19, but each of the first forward-reverse rotating roller 331, the first folding processing roller 341, and the second folding processing roller 361 may be configured with a plurality of types of rollers. A specific example of this configuration will be described with reference to FIG. 27. FIG. 27 is a perspective view illustrating the first forward-reverse rotating roller 331, the first folding processing roller 341, and the second folding processing roller 361 of the folding processing unit 3 according to the present embodiment.

The first forward-reverse rotating roller 331 according to the present embodiment is configured with two types of rollers as illustrated in FIG. 27. In other words, in the first forward-reverse rotating roller 331 according to the present embodiment, the first forward-reverse rotating roller 331*a* and the first forward-reverse rotating roller 331*d* have the same size, shape, and structure. Further, in the first forward-reverse rotating roller 331 according to the present embodiment, the first forward-reverse rotating roller 331*b* and the first forward-reverse rotating roller 331*c* have the same size, shape, and structure, but have a size, shape, and structure different from the first forward-reverse rotating roller 331*a* and the first forward-reverse rotating roller 331*d*. The same applies to the first folding processing roller 341 and the second folding processing roller 361 according to the present embodiment as illustrated in FIG. 27.

Even in the case of this configuration, it is possible to reduce the manufacturing cost of the first forward-reverse rotating roller 331, the first folding processing roller 341, and the second folding processing roller 361. Here, each of the first forward-reverse rotating roller 331, the first folding processing roller 341, and the second folding processing roller 361 is configured with two types of rollers, but the manufacturing cost of each roller can be further reduced by using a common type of roller between rollers.

Figure 28:
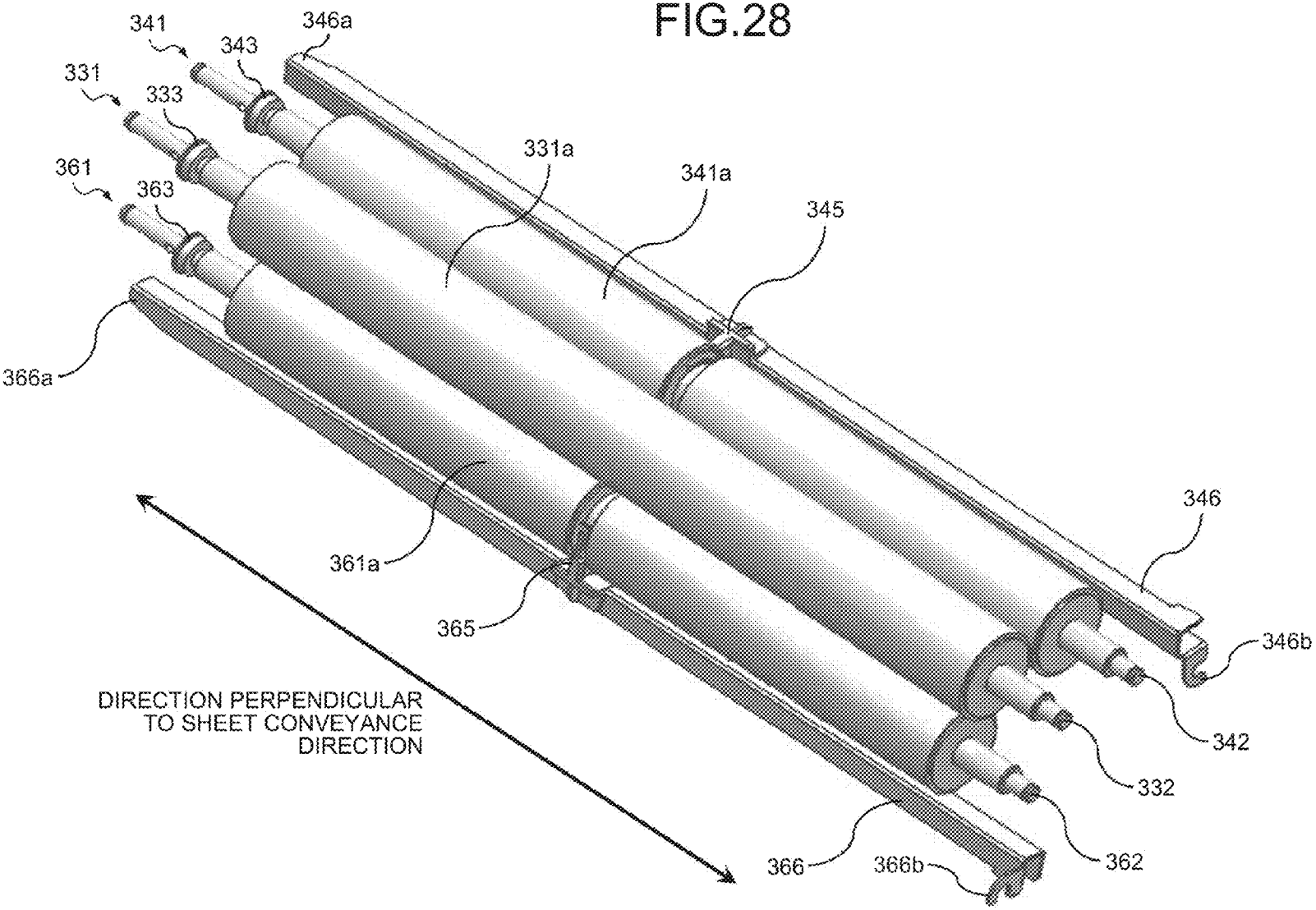
FIG. 28 is a perspective view illustrating a first forward-reverse rotating roller, a first folding processing roller, and a second folding processing roller in a folding processing unit according to an embodiment of the present invention.

Further, the present embodiment has been described in connection with the example in which each of the first forward-reverse rotating roller 331, the first folding processing roller 341, and the second folding processing roller 361 is configured with a plurality of rollers as described above with reference to FIGS. 19 and 27, but each of the first forward-reverse rotating roller 331, the first folding processing roller 341, and the second folding processing roller 361 may be configured with a single roller as illustrated in FIG. 28. FIG. 28 is a perspective view illustrating the first forward-reverse rotating roller 331, the first folding processing roller 341, and the second folding processing roller 361 of the folding processing unit 3 according to the present embodiment. In the case of this configuration, the manufacturing cost of the first forward-reverse rotating roller 331, the first folding processing roller 341, and the second folding processing roller 361 tends to increase to be higher than when each of the first forward-reverse rotating roller 331, the first folding processing roller 341, and the second folding processing roller 361 is configured with a plurality of rollers, but the other effects can be obtained, similarly to the effects of the present embodiment.

Here, since the first folding processing roller pressing member 345 and the second folding processing roller pressing member 365 are mounted on the first folding processing roller 341 and the second folding processing roller 361 in the central portion in the direction perpendicular to the sheet conveyance direction, the first folding processing roller pressing member 345 and the second folding processing roller pressing member 365 are configured so that the central portion is smaller in diameter than the other portions, and mounted to grip the outer circumference of the central portion.

Further, the present embodiment has been described in connection with the example in which the first folding processing roller pressing member 345 and the second folding processing roller pressing member 365 are mounted to the first folding processing roller 341 and the second folding processing roller 361, respectively, as described above with reference to FIG. 21, or the first forward-reverse rotating roller pressing member 335 is mounted to the first forward-reverse rotating roller 331 instead of the first folding processing roller 341 and the second folding processing roller 361 as described above with reference to FIG. 26.

Figure 29:
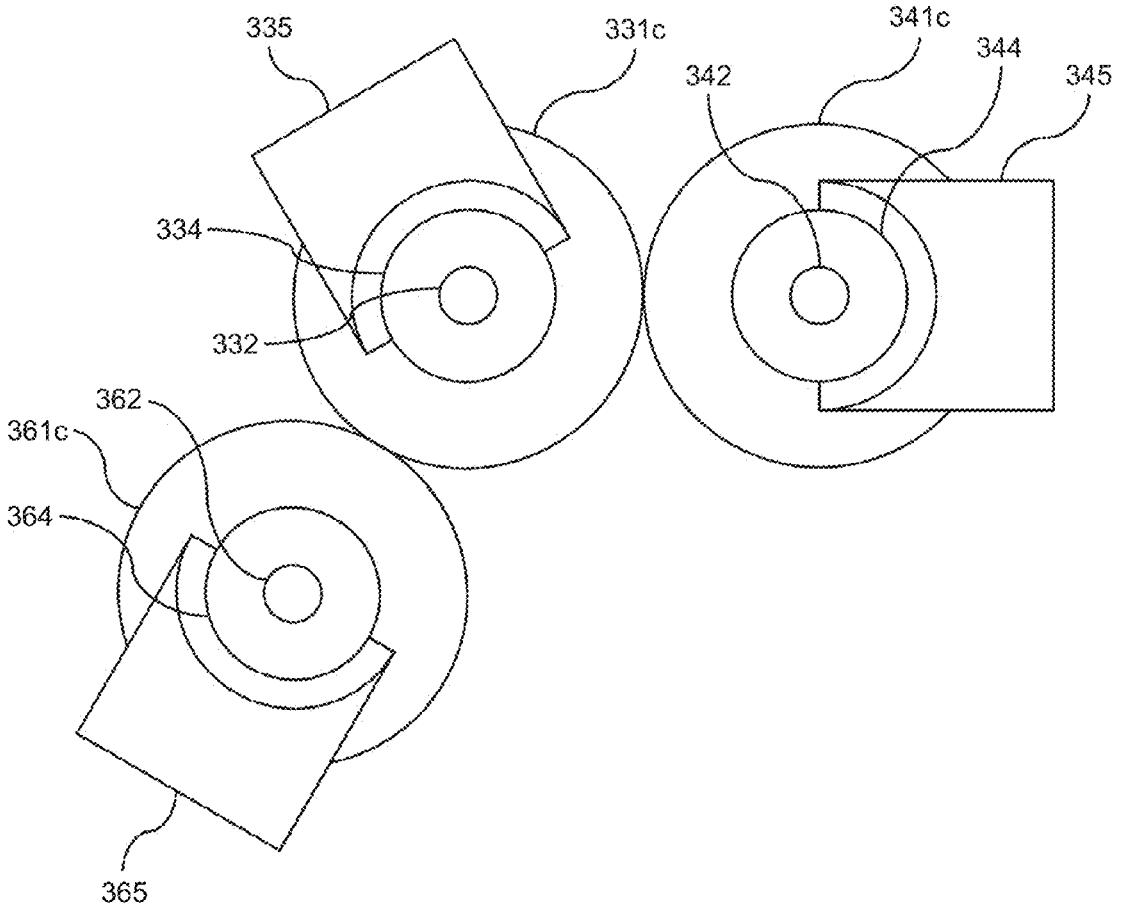
FIG. 29 is a cross-sectional view illustrating a first forward-reverse rotating roller, a first folding processing roller, and a second folding processing roller in a central portion in a direction perpendicular to a sheet conveyance direction in a folding processing unit according to an embodiment of the present invention when viewed in the direction perpendicular to the sheet conveyance direction.

Besides, the first forward-reverse rotating roller pressing member 335, the first folding processing roller pressing member 345, and the second folding processing roller pressing member 365 may be mounted to all of the first forward-reverse rotating roller 331, the first folding processing roller 341, and the second folding processing roller 361, respectively, as illustrated in FIG. 29. In the case of this configuration, since it is possible to increase the pressing force, it is possible to form a folding line more effectively.

Further, the present embodiment has been described in connection with the example in which force for firmly pressing the first folding processing roller 341 against the first forward-reverse rotating roller 331 is caused to act on the central portion of the first folding processing roller 341, and force for firmly pressing the second folding processing roller 361 against the first forward-reverse rotating roller 331 is caused to act on the central portion of the second folding processing roller 361.

Besides, force for firmly pressing the first folding processing roller 341 against the first forward-reverse rotating roller 331 may be caused to act on an arbitrary portion of the first folding processing roller 341 in the direction perpendicular to the sheet conveyance direction, and force for firmly pressing the second folding processing roller 361 against the first forward-reverse rotating roller 331 may be caused to act on an arbitrary portion of the second folding processing roller 361 in the direction perpendicular to the sheet conveyance direction. Even in the case of this configuration, the folding processing unit 3 according to the present embodiment can generate sufficient pressing force evenly over the whole area in the direction perpendicular to the sheet conveyance direction.

Further, the present embodiment has been described in connection with the configuration in which the image forming apparatus 1 is equipped with the image forming unit 2, the folding processing unit 3, the post processing unit 4, and the scanner unit 5, but the respective units may be configured as independent different apparatuses, and an image forming system may be configured by connecting the apparatuses.

According to the present invention, it is possible to form a folding line on a sheet effectively and improve a folding quality.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus, comprising:

a first pair of conveying members configured to convey a sheet;

a second pair of conveying members configured to convey the sheet conveyed by the first pair of conveying members;

a first pair of folding members configured to fold the sheet conveyed by reversing a rotation of the second pair of conveying members; and a second pair of folding members configured to further fold the sheet that has been folded by the first pair of folding members, wherein one of the folding members of the first pair of folding members serves as one of the conveying members of the second pair of conveying members, and one of the folding members of the second pair of folding members serves as the one of the folding members of the first pair of folding members.

2. The sheet processing apparatus according to claim 1, further comprising:

a third pair of conveying members configured to convey the sheet that has been folded by the first pair of folding members.

3. The sheet processing apparatus according to claim 2, wherein the second pair of folding members is configured to fold the sheet conveyed by reversing a rotation of the third pair of conveying members.

4. The sheet processing apparatus according to claim 3, further comprising:

a first detector configured to detect a leading edge of the sheet at a position upstream from the first pair of conveying members.

5. The sheet processing apparatus according to claim 4, further comprising a second detector configured to detect a leading edge of the sheet conveyed from the second pair of conveying members, wherein the rotation of the second pair of conveying members reverses at a point in time at which the sheet is conveyed by a predetermined distance after a leading edge of the sheet is detected by the second detector.

6. The sheet processing apparatus according to claim 5, further comprising:

a third detector configured to detect a leading edge of the sheet conveyed from the third pair of conveying members, wherein the rotation of the third pair of conveying members reverses at a point in time at which the sheet is conveyed by a predetermined distance after a leading edge of the sheet is detected by the third detector.

7. The sheet processing apparatus according to claim 2, wherein the third pair of conveying members includes conveying rollers.

8. The sheet processing apparatus according to claim 2, further comprising:

a fourth pair of conveying members, the fourth pair of conveying members configured to convey the sheet that has been folded by the second pair of folding members.

9. The sheet processing apparatus according to claim 8, wherein the fourth pair of conveying members is separate from the second pair of folding members.

10. The sheet processing apparatus according to claim 2, wherein the third pair of conveying members is separate from the first pair of folding members.

11. The sheet processing apparatus according to claim 1, wherein the first pair of conveying members includes conveying rollers.

12. The sheet processing apparatus according to claim 1, wherein the second pair of conveying members includes conveying rollers.

13. The sheet processing apparatus according to claim 1, wherein the first pair of folding members includes folding rollers.

14. The sheet processing apparatus according to claim 1, wherein the second pair of folding members includes folding rollers.

15. The sheet processing apparatus according to claim 1, wherein the first pair of folding members and the second pair of folding members are configured to perform a Z folding on the sheet.

16. The sheet processing apparatus according to claim 1, wherein the first pair of folding members and the second pair of folding members are configured to perform inside triple folding on the sheet.

17. The sheet processing apparatus according to claim 1, wherein the first pair of folding members and the second pair of folding members are configured to perform outside triple folding on the sheet.

18. The sheet processing apparatus according to claim 1, wherein the first pair of folding members and the second pair of folding members are configured to perform single folding on the sheet.

19. The sheet processing apparatus according to claim 1, wherein another folding member of the first pair of folding members is configured to apply a first force to the one of the folding members of the first pair of folding members.

20. The sheet processing apparatus according to claim 19, wherein another folding member of the second pair of folding members is configured to apply a second force to the one of the folding members of the first pair of folding members.

21. The sheet processing apparatus according to claim 1, wherein another folding member of the second pair of folding members is configured to apply a force to the one of the folding members of the first pair of folding members.

* * * * *